US009335778B2

(12) United States Patent
Furusawa et al.

(10) Patent No.: US 9,335,778 B2
(45) Date of Patent: May 10, 2016

(54) REFERENCE VOLTAGE GENERATING CIRCUIT

(71) Applicant: RENESAS ELECTRONICS CORPORATION, Kanagawa (JP)

(72) Inventors: Kenji Furusawa, Kanagawa (JP); Mitsuya Fukazawa, Kanagawa (JP)

(73) Assignee: RENESAS ELECTRONICS CORPORATION, Tokyo (JP)

( * ) Notice: Subject to any disclaimer, the term of this patent is extended or adjusted under 35 U.S.C. 154(b) by 0 days.

(21) Appl. No.: 14/641,272

(22) Filed: Mar. 6, 2015

(65) Prior Publication Data

US 2015/0177770 A1 Jun. 25, 2015

Related U.S. Application Data

(63) Continuation of application No. 13/738,546, filed on Jan. 10, 2013, now Pat. No. 8,988,137.

(30) Foreign Application Priority Data

Jan. 23, 2012 (JP) ..... 2012-011143

(51) Int. Cl.
*G05F 3/30* (2006.01)
*G05F 3/16* (2006.01)

(52) U.S. Cl.
CPC ... *G05F 3/16* (2013.01); *G05F 3/30* (2013.01)

(58) Field of Classification Search
CPC ..... G05F 3/222; G05F 3/225; G05F 3/242; G05F 3/245; G05F 3/30
See application file for complete search history.

(56) References Cited

U.S. PATENT DOCUMENTS

| | | | | |
|---|---|---|---|---|
| 5,774,013 | A | 6/1998 | Groe | |
| 6,172,555 | B1 | 1/2001 | Gusinov | |
| 6,891,358 | B2 * | 5/2005 | Marinca | G05F 3/30 323/315 |
| 7,420,359 | B1 | 9/2008 | Anderson et al. | |
| 7,598,799 | B2 | 10/2009 | Marinca | |
| 7,843,254 | B2 | 11/2010 | Chellappa | |

* cited by examiner

*Primary Examiner* — Jeffrey Zweizig
(74) *Attorney, Agent, or Firm* — McDermott Will & Emery LLP

(57) ABSTRACT

A reference voltage generating circuit with extremely low temperature dependence is provided. The reference voltage generating circuit includes a BGR circuit which generates a bandgap reference voltage; a bandgap current generating circuit which generates a bandgap current according to the bandgap reference voltage; a PTAT current generating circuit which generates a current proportional to the absolute temperature; and a linear approximate correction current generating circuit which compares the current generated by the PTAT current generating circuit and the bandgap current to generate a correction current, and the BGR circuit adds, to the bandgap reference voltage, a correction voltage generated based on the correction current.

4 Claims, 17 Drawing Sheets

REFERENCE VOLTAGE GENERATING CIRCUIT

CROSS-REFERENCE TO RELATED APPLICATION

This is a continuation application under 35 U.S.C. 111(a) of pending U.S. patent application Ser. No. 13/738,546, filed Jan. 10, 2013, which in turn claims the benefit of Japanese Patent Application No. 2012-011143 filed on Jan. 23, 2012, the disclosures of which Application are incorporated reference herein in its entirety.

BACKGROUND

The present invention relates to a reference voltage generating circuit.

In order to enhance precision of semiconductor circuits, and particularly analog circuits, those having a smaller variation of reference voltage against temperature variation are required.

For such a requirement, a reference voltage generating circuit such as the one de scribed below is disclosed in U.S. Pat. No. 7,420,359 (Patent Document 1), for example.

A voltage obtained by resistance-dividing a voltage which is retrieved from a resistor coupled to a BGR (BandGap Reference) circuit and which is proportional to the absolute temperature (PTAT voltage: Proportional To Absolute Temperature voltage) and an output voltage of the BGR circuit is input to a correction circuit including a differential pair. The differential pair of the correction circuit generates a correction current according to the difference of input voltage which varies according to the temperature. Causing the generated correction current to flow again in the resistance coupled to the BGR circuit corrects the reference voltage which is output from the BGR circuit and varies according to the temperature variation.

SUMMARY

In Patent Document 1, however, the temperature characteristic is corrected by providing the differential pair with a potential difference which varies according to the temperature to generate a correction current having a reverse characteristic with respect to the secondary characteristic of the temperature characteristic of the BGR and feeding the correction current back to the resistance in the BGR circuit to add the voltage. Accordingly, the correction voltage tends to depend on the transconductance and the resistance-divided resistance value, whereby variation of the process also varies the correction voltage, which may lead to failure in obtaining desired characteristics.

Therefore, it is an object of the present invention to provide a reference voltage generating circuit having extremely low temperature dependence by dividing the temperature characteristic of the output of the reference voltage generating circuit into sections which are then approximated by linear approximation, and adding the voltage having the reverse characteristic of the approximated sections.

According to an embodiment of the present invention, a reference voltage generating circuit includes a bandgap reference circuit which generates a bandgap reference voltage; a bandgap current generating circuit which generates a bandgap current according to the bandgap reference voltage; a PTAT current generating circuit which generates a current proportional to the absolute temperature; and a correction circuit which compares the current generated by the PTAT current generating circuit and the bandgap current to generate a correction current, and the bandgap reference circuit outputs a bandgap reference voltage to which the correction voltage generated based on the correction current is added.

According to a reference voltage generating circuit of an embodiment of the present invention, temperature dependence of the bandgap reference voltage can be significantly reduced.

DETAILED DESCRIPTION

Figure 1:
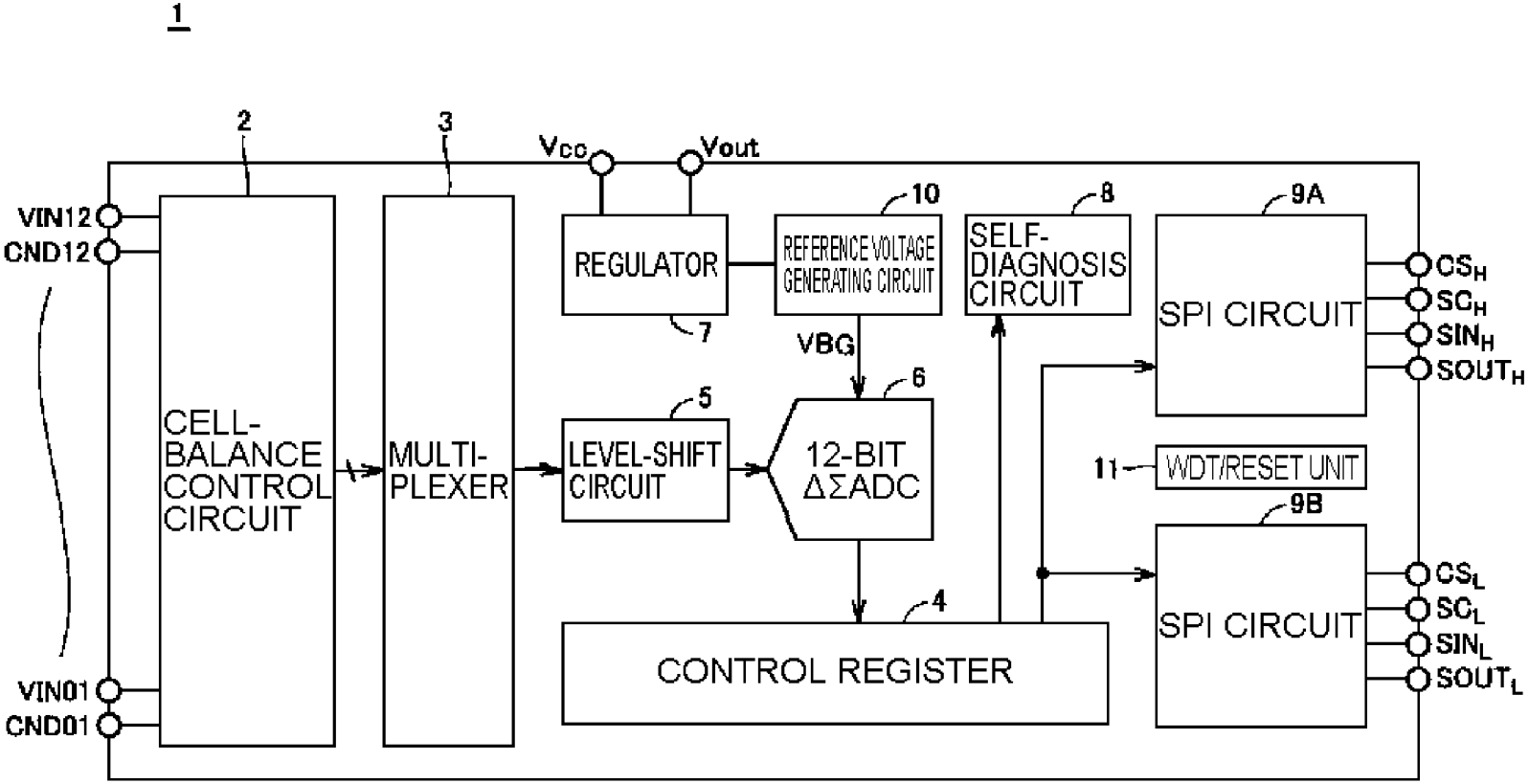
FIG. 1 shows a configuration of a semiconductor device of a first embodiment of the present invention.

The present invention will be described in detail below, referring to the drawings. Note that, in all the drawings for explaining embodiments, the same symbol is attached to the same member, as a principle, and the repeated explanation thereof is omitted.

First Embodiment

FIG. 1 shows a configuration of a semiconductor device of a first embodiment of the present invention.

Referring to FIG. 1, a semiconductor device 1, which is used for battery monitoring, includes a cell-balance control circuit 2, a multiplexer 3, a reference voltage generating circuit 10, a regulator 7, a self-diagnosis circuit 8, a level-shift circuit 5, a 12-bit ΔΣADC 6, SPI (Serial Peripheral Interface) circuits 9A and 9B, a WDT/Reset unit 11, and a control register 4.

The cell-balance control circuit 2 receives voltages VIN01 to VIN12 and CIN0 to CIN12 of a number of batteries coupled in series, and controls to perform well-balanced charging for the unbalance that occurred in electric discharge of these batteries.

The multiplexer 3 selects and outputs one among the 12 outputs from the cell-balance control circuit 2.

The level-shift circuit 5 converts the level of voltage to be provided to the 12-bit ΔΣADC 6. The reference voltage generating circuit 10 supplies a highly precise bandgap reference voltage VBG to the 12-bit ΔΣADC 6.

The regulator 7 amplifies and outputs the bandgap reference voltage VGB, or adjusts an external power source VCC and supplies it to an internal circuit.

The 12-bit ΔΣADC 6 calculates the difference (Δ) between the analog voltage output from the multiplexer and a signal obtained by DA (Digital to Analog) converting and integrating the digital output, and outputs, to the control register 4, a 12-bit value quantized by comparing a signal obtained by integration (Σ) of the difference with the reference voltage.

The self-diagnosis circuit 8 diagnoses abnormality of the voltages VIN01 to VIN12 and CIN0 to CIN12 of the battery.

The SPI circuits 9A and 9B control another IC (Integrated Circuit), based on the output value of the 12-bit ΔΣADC 6 in the control register 4.

The WDT/Reset unit 11 performs a watchdog timer function and a reset function. Since a highly precise bandgap reference voltage VBG is supplied to the 12-bit ΔΣADC 6 from the reference voltage generating circuit 10, in the semiconductor device 1 of FIG. 1, the monitoring precision of the battery increases.

By mounting a reference voltage generating circuit described below on the semiconductor device 1, the high precision can be maintained without lowering the precision of voltage detection of the ΔΣADC against temperature variation. Accordingly, performance of the semiconductor device can be improved.

(Outline of Reference Voltage Generating Circuit 10)

Figure 2:
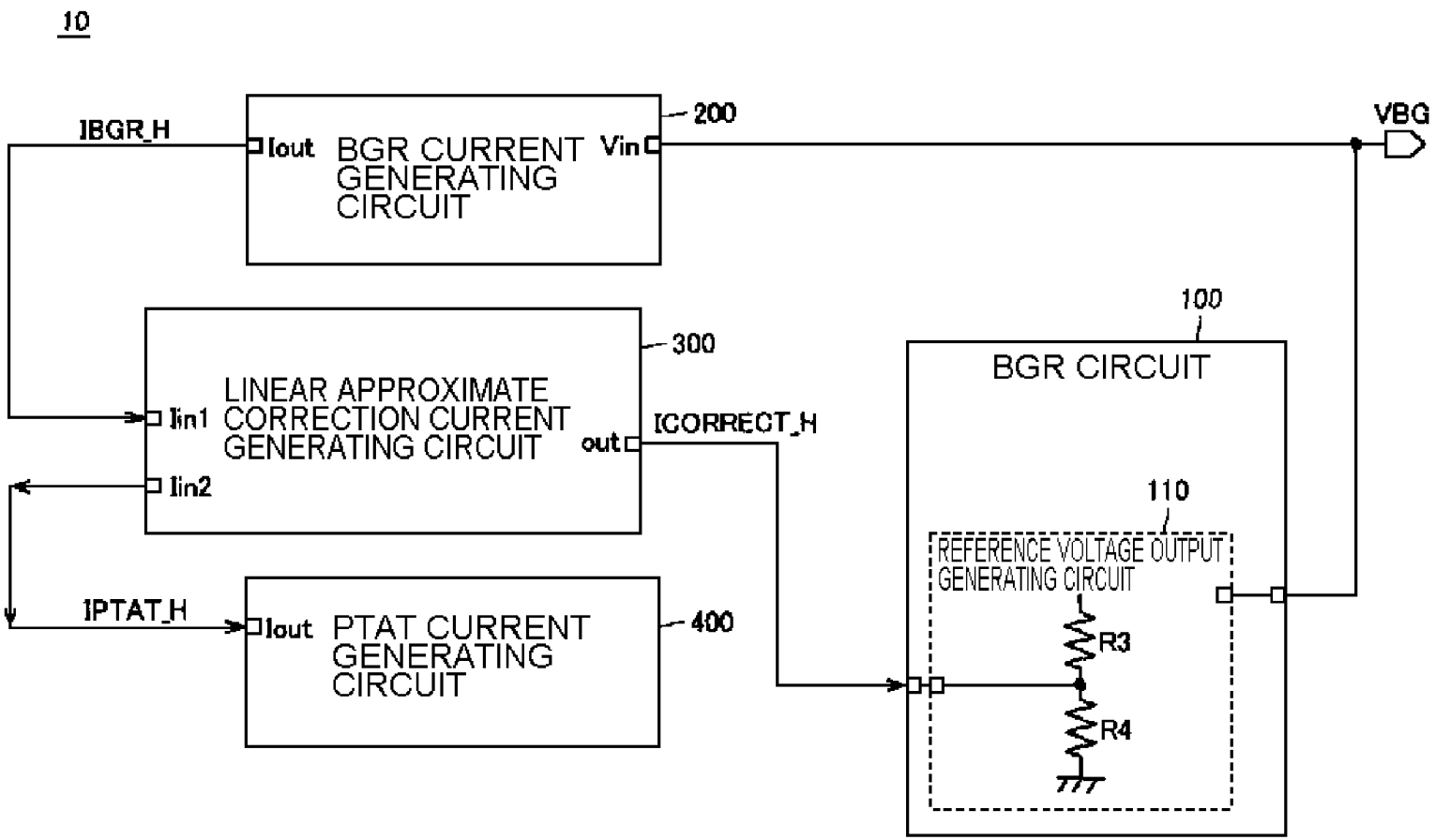
FIG. 2 outlines a configuration of a reference voltage generating circuit 10 of an embodiment of the present invention.

FIG. 2 outlines a configuration of the reference voltage generating circuit 10 of the embodiment of the present invention.

Referring to FIG. 2, the reference voltage generating circuit 10 includes a BGR circuit 100, a BGR current generating circuit 200, a linear approximate correction current generating circuit 300, and a PTAT (Proportional To Absolute Temperature) current generating circuit 400. The BGR circuit 100 includes a reference voltage output generating circuit 110. The reference voltage output generating circuit 110 includes resistors R3 and R4.

A bandgap reference voltage VBG is input to a terminal Vin of the BGR current generating circuit 200, and a current IBGR_H is output from a terminal Iout to the linear approximate correction current generating circuit 300. The BGR current IBGR_H is configured to be clamped at a predetermined current value (IBGR_H_MAX) when a predetermined temperature (e.g., T1 of FIGS. 5A to 5C) is reached, as will be described below. The temperature dependence of the current value (IBGR_H_MAX) is smaller than the temperature dependence of a current IPTAT_H flowing into the PTAT current generating circuit 400.

On the other hand, the current IPTAT_H proportional to the absolute temperature is output from a terminal Iin2 of the linear approximate correction current generating circuit 300 to the terminal Iout of the PTAT current generating circuit 400.

The linear approximate correction current generating circuit 300 compares a predetermined clamped current value (IBGR_H_MAX) of the BGR current generating circuit 200 and the current (IPTAT_H) proportional to the absolute temperature from the PTAT current generating circuit 400 and, if the current IPTAT_H becomes larger than the current IBGR_H_MAX, a correction current ICORRECT_H is generated and output from a terminal out to the BGR circuit 100. The correction current has a reverse characteristic with respect to the temperature characteristic of the bandgap reference voltage VBG.

The reference voltage output generating circuit 110 adds the correction voltage generated based on the correction current ICORRECT_H and the bandgap reference voltage, and outputs the result as the bandgap reference voltage VBG.

(Details of Reference Voltage Generating Circuit 10)

Figure 3:
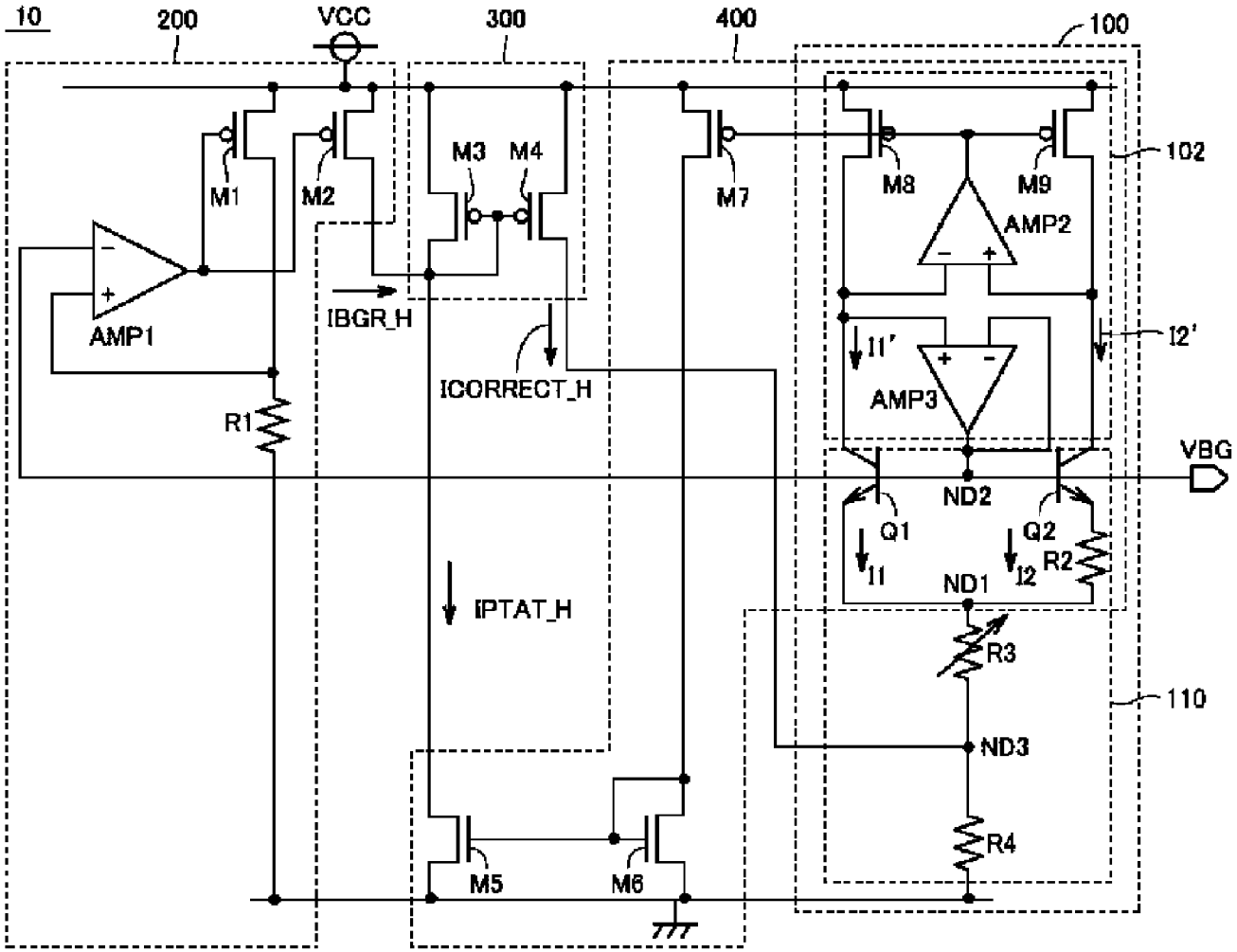
FIG. 3 shows a configuration of the reference voltage generating circuit 10 of the first embodiment.

FIG. 3 shows a configuration of the reference voltage generating circuit 10 of the first embodiment. Referring to FIG. 3, the reference voltage generating circuit 10 includes the BGR circuit 100, the BGR current generating circuit 200, the linear approximate correction current generating circuit 300, a PMOS transistor M7, and NMOS transistors M5 and M6. Here, a current source 102, NPN-type bipolar transistors Q1 and Q2, a resistor R2, the PMOS transistor M7, and the NMOS transistors M5 and M6 are also collectively referred to as the PTAT current generating circuit 400.

(BGR Circuit 100)

As shown in FIG. 3, the BGR circuit 100 includes the current source 102 and the reference voltage output generating circuit 110. The reference voltage output generating circuit 110 includes NPN-type bipolar transistors Q1 and Q2, and resistors R2 to R4. Note that, although the resistor R3 indicates a variable resistor which can perform fine adjustment of resistance values by trimming, it need not be a variable resistor.

The current source 102 outputs currents I1' and I2' of an approximately same magnitude. The current source 102 includes PMOS transistors M8 and M9, an amplifier AMP2 which performs feedback, and an amplifier AMP3 constituting a voltage follower.

The PMOS transistors M8 and M9 constitute a current mirror circuit. A source of the PMOS transistor M8 and a source of the PMOS transistor M9 are coupled to the power source VCC. A drain of the PMOS transistor M8 is coupled to a collector terminal of the NPN-type bipolar transistor Q1. A drain of the PMOS transistor M9 is coupled to a collector terminal of the bipolar transistor Q2.

A positive input terminal of the amplifier AMP2 is coupled to the drain of the PMOS transistor M9 and the collector terminal of the bipolar transistor Q2. A negative input terminal of the amplifier AMP2 is coupled to the drain of the PMOS transistor M8 and the collector terminal of the NPN-type bipolar transistor Q1. An output terminal of the amplifier AMP2 is coupled to a gate of the PMOS transistor M8 and a gate of the PMOS transistor M9.

When the sizes of the PMOS transistor M8 and the PMOS transistor M9 are equal, the amplifier AMP2 makes the magnitude of the current I1' sent from the current source 102 to the NPN-type bipolar transistor Q1 approximately equal to that of the current I2' sent from the current source 102 to the bipolar transistor Q2.

A positive input terminal of the AMP3 is coupled to the drain of the PMOS transistor M8 and the collector terminal of the NPN-type bipolar transistor Q1. An output terminal of the amplifier AMP3 is coupled to a node ND2 and is also coupled to the negative input terminal of the amplifier AMP3.

The collector terminal of the NPN-type bipolar transistor Q1 is coupled to the drain of the PMOS transistor M8, through which the current I1' is caused to flow.

A base terminal of the NPN-type bipolar transistor Q1 is coupled to the node ND2 and the emitter terminal is coupled to a node ND1.

The collector terminal of the bipolar transistor Q2 is coupled to the drain of the PMOS transistor M9, through which the current I2' is caused to flow. Note that, the currents I1 and I2 are emitter currents of the bipolar transistors Q1 and Q2, respectively.

A base terminal of the bipolar transistor Q2 is coupled to the node ND2, and its emitter terminal is coupled to the resistor R2.

One of the terminals of the resistor R2 is coupled to the emitter terminal of the bipolar transistor Q2 and the other terminal is coupled to the node ND1.

The resistors R3 and R4 are coupled in series and provided between the node ND1 and the ground.

The node ND2 to which the base terminal of the NPN-type bipolar transistor Q1 and the base terminal of the bipolar transistor Q2 are coupled outputs the bandgap reference voltage VBG.

(BGR Current Generating Circuit 200)

The BGR current generating circuit 200 includes an AMP1, PMOS transistors M1 and M2, and a resistor R1.

Sources of the PMOS transistors M1 and M2 are coupled to the power source voltage VCC, and their gates receive the output of the AMP1.

A drain of the PMOS transistor M1 is coupled to one end of the resistor R1, and is also coupled to the positive input terminal of the AMP1.

A drain signal of the PMOS transistor M2 is output to the linear approximate correction current generating circuit 300.

The positive input terminal of the AMP1 is coupled to the drain of the PMOS transistor M1 and one end of the resistor R1. The positive input terminal of the AMP1 is coupled to the base terminals of the NPN-type bipolar transistors Q1 and Q2. The output terminal of the amplifier AMP3 is coupled to the gates of the PMOS transistors M1 and M2.

The resistor R1 is coupled between the drain of the PMOS transistor M1 and the ground. The current generated by the BGR current generating circuit 200 is output to the linear approximate correction current generating circuit 300 as the current IBGR_H. Since the PMOS transistors M1 and M2 are configured as a current mirror, the current flowing in the PMOS transistor M1 and the current flowing in the PMOS transistor M2 are proportional to the current mirror ratio when the PMOS transistor M2 operates in the saturated region, and the maximum output current value of the current IBGR_H becomes a current value (IBGR_H_MAX) proportional to the current flowing in the PMOS transistor M1.

(Linear Approximate Correction Current Generating Circuit 300)

The linear approximate correction current generating circuit 300, which is a source-type linear approximate correction current generating circuit, includes PMOS transistors M3 and M4. Sources of the PMOS transistors M3 and M4 are coupled to the power source voltage VCC, and their gates are coupled to the drain of the PMOS transistor M2 of the BGR current generating circuit 200 to receive the output from the BGR current generating circuit 200.

The drain of the PMOS transistor M3 also receives the output from the BGR current generating circuit 200. The linear approximate correction current generating circuit 300 outputs the BGR current IBGR_H of the BGR current generating circuit to the PTAP current generating circuit 400 as the current IPTAT_H until a predetermined temperature (e.g., T1 of FIGS. 5A to 5C) is reached, as described below. This is because the PMOS transistor M2 operates in the linear region and cuts off the PMOS transistors M3 and M4. When the predetermined temperature (T1) is exceeded, the current IPTAT_H flowing into the PTAP current generating circuit 400 becomes larger than the maximum output current value (IBGR_H_MAX) of the BGR current generating circuit, and therefore the differential current (i.e., the current obtained by subtracting the current IBGR_H_MAX from the current IPTAT_H) flows from the PMOS transistor M3 into the drain of the PMOS transistor M3 in the correction current generating circuit 300. The PMOS transistors M3 and M4 constitute a current mirror circuit, and a current proportional to the current flowing in the PMOS transistor M3 is output from the PMOS transistor M4 to the reference voltage output generating circuit 110 as the correction current ICORRECT_H.

(PTAT Current Generating Circuit 400)

The PTAT current generating circuit 400 is duplicated with a part of the BGR circuit 100. The PTAT current generating circuit 400 includes the NMOS transistors M5 and M6, the PMOS transistor M7, the current source 102, the NPN-type bipolar transistors Q1 and Q2, and the resistor R2.

The NMOS transistors M5 and M6 constitute a current mirror, with the sources of the NMOS transistors M5 and M6 being provided with the ground potential. In addition, the gates of the NMOS transistors M5 and M6 are coupled to the drain of the NMOS transistor M6, and are also coupled to the drain of the PMOS transistor M7.

The drain of the NMOS transistor M5 receives the current IPTAT_H which is the output of the linear approximate correction current generating circuit 300.

The gate of the PMOS transistor M7 is coupled to the gates of the PMOS transistors M8 and M9 of the current source 102, and the source of the PMOS transistor M7 is coupled to the power source voltage VCC. The drain of the PMOS transistor M7 is coupled to the gates of the NMOS transistors M5 and M6, and is also coupled to the drain of the NMOS transistor M6.

(AMP1)

Figure 4:
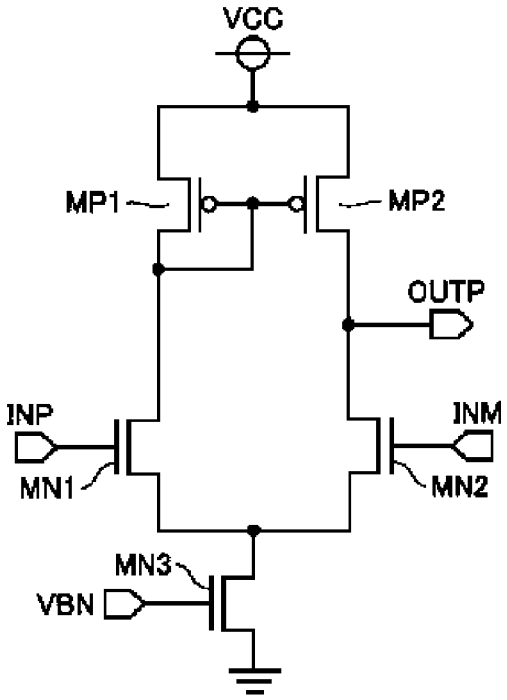
FIG. 4 shows a configuration of an AMP1 of FIG. 3.

FIG. 4 shows a configuration of the AMP1 of FIG. 3.

Referring to FIG. 4, the amplifier AMP1 includes NMOS transistors MN1 and MN2 constituting an input differential pair, an NMOS transistor MN3 constituting a tail current source, and PMOS transistors MP1 and MP2 corresponding to the load. A constant bias voltage VBN is input to the gate of the NMOS transistor MN3. The coupling node of the PMOS transistor MP2 and the NMOS transistor MN2 is the output terminal of the AMP1, which outputs a voltage OUTP.

Note that, the amplifiers AMP2 and AMP3, as well as amplifiers AMP4 and AMP5 described below, have a similar configuration to the AMP1 and therefore explanation of amplifiers AMP2 to AMP5 will not be repeated.

(Correction Current)

Figure 5A:
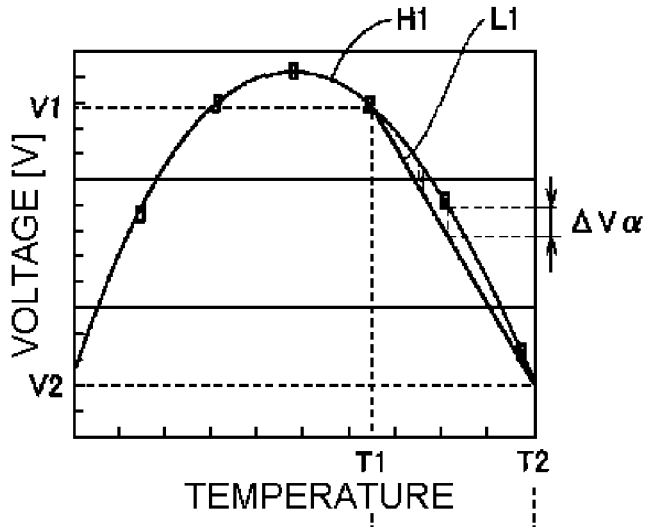
FIGS. 5A to 5C are explanatory diagrams of an operation of the reference voltage generating circuit 10 according to the first embodiment.
Figure 5B:
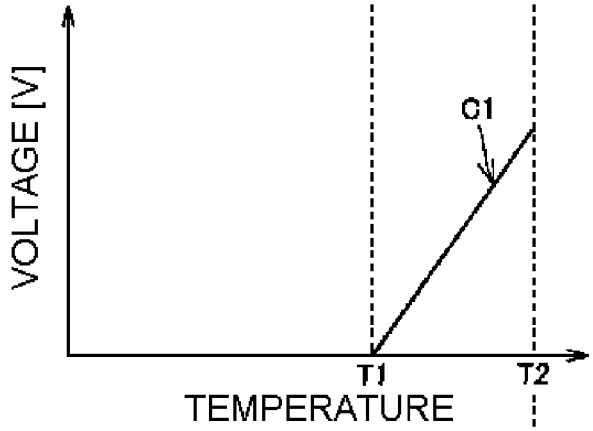
Figure 5C:
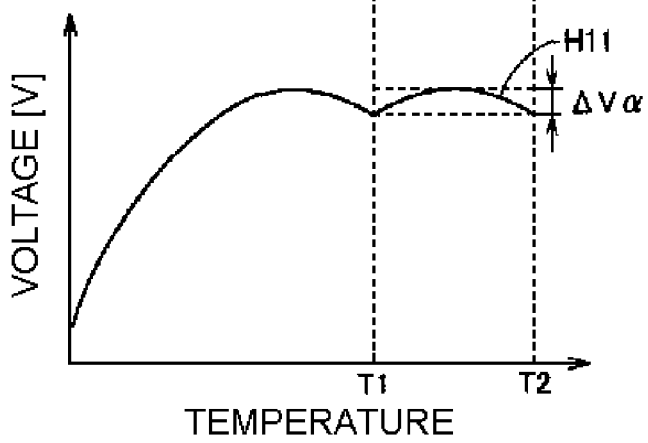

FIGS. 5A to 5C are explanatory diagrams of an operation of the reference voltage generating circuit 10 according to the first embodiment. FIG. 5A shows how a conventional bandgap reference voltage VBG varies according to the temperature. As shown in FIG. 5A, the vertical axis represents the voltage [V] and the horizontal axis represents the temperature. In addition, a wave pattern H1 represents the secondary characteristic of the bandgap reference voltage VBG. The straight line L1 represents the linear approximation of the wave pattern H1 against the temperatures T1 and T2. The temperatures T1 and T2 are determined by setting the size of the resistors R1 and R2, the area ratio of the NPN-type bipolar transistors Q1 and Q2, and the current mirror ratio as will be described below. Although not shown, the conventional bandgap reference voltage VBG varies in a range of a few mV, according to temperature. Here, a setting of around T1=60° C. and T2=120° C. is preferred.

The purpose of the first embodiment of the present invention is to generate a bandgap reference voltage VBG with extremely low temperature dependence by making the variation much smaller in a range of a few mV at the high-temperature side.

FIG. 5B shows a correction voltage required to prevent the bandgap reference voltage VBG from varying according to the temperature.

As shown in FIG. 5B, the vertical axis represents the voltage [V] and the horizontal axis represents the temperature. In addition, the wave pattern C1 represents the correction voltage generated based on the voltage of the straight line L1 which is the linear approximation of the wave pattern H1 against the temperatures T1 to T2.

A method of generating the correction voltage will be described below. Referring again to FIG. 3, the current ICONST (constant) flowing in the resistor R1 of the BGR current generating circuit 200 is expressed by Expression (1). Note that, since the influence of temperature dependence of the resistor R1 is canceled when converting current into voltage as will be described below, there is provided the notation current ICONST (constant).

[Formula 1]

$$ICONST=V_{VBG}/R_1 \quad \text{Expression (1)}$$

Here, $V_{VBG}$ indicates the bandgap reference voltage VBG. Therefore, the maximum value of the current IBGR_H (IBGR_H_MAX) output from the BGR current generating circuit 200 is expressed by Expression (2).

[Formula 2]

$$IBGR_H_MAX=b*ICONST \quad \text{Expression (2)}$$

Here, b is a proportionality constant, which is a value determined by the current mirror ratio between the PMOS transistors M1 and M2.

On the other hand, applying a forward voltage Vd between the base and emitter of the bipolar transistor Q2 in order to calculate the current output from the PTAT current generating circuit 400 provides the relation with the collector current I at that time expressed by Expression (3).

[Formula 3]

$$Vd=(k_BT/q)*\ln(I/I_S) \quad \text{Expression (3)}$$

Here, q is the electron charge, $k_B$ is the Boltzmann constant, T indicates the absolute temperature, and $I_s$, referred to as reverse saturation current, is a value proportional to the area of the bipolar emitter.

Using Expression (3), the current I2 flowing in the resistor R2 is expressed by Expression (4). Note that, here, the constant M expresses the area ratio of the bipolar transistor Q2 against the NPN-type bipolar transistor Q1. It is to be noted that the constant M is preferably about eight.

[Formula 4]

$$I2=V_T\ln(M)/R_2$$

$$V_T=k_BT/q \quad \text{Expression (4)}$$

The current IPTAT_H, having a proportional relation with the collector current I2' of the bipolar transistor Q2 due to the current mirror configuration of the NMOS transistors M5 and M6 and the current mirror configuration of the PMOS transistors M7 and M9, is expressed by Expression (5) in relation to the current I2' and the emitter current I2 of the bipolar transistor Q2.

[Formula 5]

$$IPTAT_H=a*I2'=a*(\beta/(1+\beta))*I2 \quad \text{Expression (5)}$$

Here, a, expressing a proportionality constant, is a value determined by the current ratio due to the current mirror between the NMOS transistors M5 and M6 and the current mirror ratio between the PMOS transistors M7 and M9. β expresses the grounded emitter amplification factor of the bipolar transistor Q2.

The condition under which the correction current ICORRECT_H begins to flow is the condition such that the current IPTAT_H flowing into the PTAP current generating circuit 400 becomes larger than the maximum output current value (IBGR_H_MAX) of the BGR current generating circuit, which needs to satisfy the condition expressed by Expression (6).

[Formula 6]

$$IBGR_H_MAX \geq IPTAT_H \quad \text{Expression (6)}$$

Letting T1 be the temperature T when the current IBGR_H becomes equal to the current IPTAT_H using Expression (6), T1 is expressed by Expression (7). As indicated by Expression (7), the temperature T1 can be set by the proportionality constants a and b based on the current mirror ratio, the ratio between the resistors R1 and R2 or the like. Since the resistors R1 and R2 appear on the denominator and the numerator, respectively, as indicated by Expression (7), temperature dependence between the resistors R1 and R2 can be canceled by fabricating the resistors R1 and R2 over a same semiconductor chip using materials having identical temperature characteristics, for example.

[Formula 7]

$$T_1=(b/a)*((1+\beta)/\beta)*(R_2/R_1)*(q/k_B)*(1/\ln(M))*V_{VBG} \quad \text{Expression (7)}$$

The correction current ICORRECT_H, which is a current proportional to the difference between the current IPTAT_H and the current IBGR_H_MAX, is expressed by Expression (8).

[Formula 8]

$$ICORRECT_H=IPTAT_H-IBGR_H_MAX \quad \text{Expression (8)}$$

Substituting Expressions (5) and (4) into the current IPTAT_H of an Expression (8) and substituting Expressions (2) and (1) into the current IBGR_H_MAX, and replacing the constant term with the temperature T1 using Expression (7), the correction current ICORRECT_H is expressed by Expression (9).

[Formula 9]

$$ICORRECT_H=a*(\beta/(1+\beta))*(\ln(M)/R_2)*(k_B/q)*(T-T_1) \quad \text{Expression (9)}$$

As indicated by Expression (9), assuming that the temperature T1 is 60° C., for example, the current value of the current ICORRECT_H with the temperature T being equal to or higher than 60° C. can be calculated from Expression (9).

Then, the correction current ICORRECT_H then flows into the resistor R4 of the reference voltage output generating circuit 110 to generate the correction voltage. The correction voltage is a value obtained by multiplying the current ICORRECT_H with the value of resistor R4, with the gradient C of the wave pattern C1 shown in FIG. 5B being expressed by Expression (10). Since the values of resistors R4 and R2 appear on the numerator and the denominator, respectively, as indicated by Expression (10), temperature dependence between the resistors R4 and R2 can be canceled by fabricating the resistors R4 and R2 over a same semiconductor chip using materials having identical temperature characteristics, for example.

[Formula 10]

$$V_2-V_1=C*(T_2-T_1)$$

$$C=a*(\beta/(1+\beta))*(R_4*\ln(M)/R_2)*(k_B/q) \quad \text{Expression (10)}$$

Here, the relation between the potential difference ΔV=V2−V1 and the temperature difference ΔT=T2−T1 is expressed by Expression (11).

[Formula 11]

$$\Delta V=a*(\beta/(1+\beta))*(R_4*\ln(M)/R_2)*(k_B/q)*\Delta T$$

$$\Delta V=V_2-V_1$$

$$\Delta T=T_2-T_1 \quad \text{Expression (11)}$$

FIG. 5C shows the bandgap reference voltage of FIG. 5A with the correction voltage of FIG. 5B added thereto. As shown in FIG. 5A, for the temperature range of T1 to T2, whereas variation of the bandgap reference voltage is quadratic against the temperature, addition of the linearly approximated correction voltage causes variation of the bandgap reference voltage to decrease in the temperature range of T1 to T2, which results in reduced temperature dependence as shown in FIG. 5C. Variation of the bandgap reference voltage at this time is limited to around the potential difference ΔVα between the wave pattern H1 and the straight line L1 of FIG. 5A.

Accordingly, with a configuration such as the first embodiment, variation of the bandgap reference voltage at the high-temperature side can be suppressed, and whereby a reference voltage with extremely low temperature dependence can be generated.

Second Embodiment

Outline of Reference Voltage Generating Circuit 10A

Figure 6:
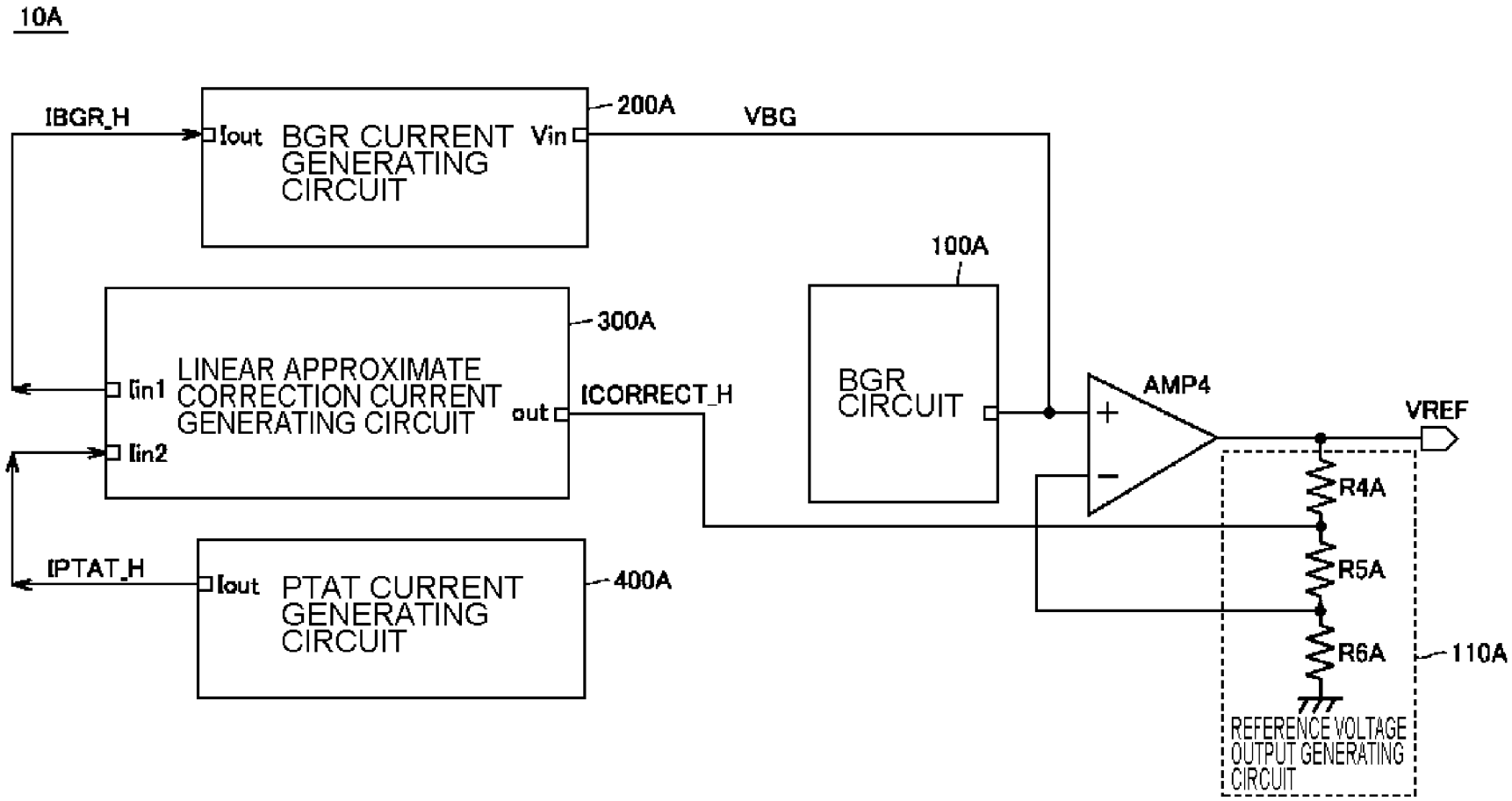
FIG. 6 outlines a configuration of a reference voltage generating circuit of a second embodiment of the present invention.

A reference voltage generating circuit 10A of a second embodiment will be described in comparison with the reference voltage generating circuit 10 of the first embodiment. FIG. 6 outlines a configuration of a reference voltage generating circuit of the second embodiment of the present invention. Referring to FIG. 6, the reference voltage generating circuit 10A includes a BGR circuit 100A, a BGR current generating circuit 200A, a linear approximate correction current generating circuit 300A, and a PTAT current generating circuit 400A.

The reference voltage generating circuit 10A further includes the AMP4 and a reference voltage output generating circuit 110A. The reference voltage output generating circuit 110A includes resistors R4A to R6A.

With the reference voltage generating circuit 10A, as shown in FIG. 6, the reference voltage output generating circuit 110 which has been provided within the BGR circuit 100 of FIG. 2 may be provided outside the BGR circuit 100A. In other words, the output voltage of the reference voltage as shown in FIG. 2 may be generated within the BGR circuit 100, or a reference voltage with extremely low temperature dependence similarly to the first embodiment can be generated by generating the reference voltage using the reference voltage output generating circuit 110A outside the BGR circuit 100A as shown in FIG. 6.

The terminal Vin of the BGR current generating circuit 200A receives the bandgap reference voltage VBG, and the current IBGR_H flows in from the terminal Iout. Although the direction of flow of the current IBGR_H varies, a configuration is provided to realize the principle of operation such that the current IBGR_H is clamped at a predetermined current value (IBGR_H_MAX) when the predetermined temperature (T1) is reached as has been described above, whereby the temperature dependence of the current value (IBGR_H_MAX) is smaller than the temperature dependence of the current IPTAT_H flowing into the PTAT current generating circuit 400.

On the other hand, the current IPTAT_H proportional to the absolute temperature is output from the terminal Iout of the PTAT current generating circuit 400A to the linear approximate correction current generating circuit 300A.

When the current IPTAT_H flowing in the PTAT current generating circuit 400A becomes larger than the current IBGR_H flowing in the BGR current generating circuit 200A, in the linear approximate correction current generating circuit 300A, the correction current ICORRECT_H flows into the terminal out thereof from the reference voltage output generating circuit 110A.

The reference voltage output generating circuit 110A includes a plurality of resistors R4A to R6A, the resistors R4A to R6A being coupled in series between the reference voltage VREF and the ground. The correction current ICORRECT_H described above flows out from the coupling node ND3A between the resistors R4A and R5A. The correction current has a reverse characteristic with respect to the temperature characteristic of the bandgap reference voltage VBG.

In the AMP4, its positive input terminal is coupled to the bandgap reference voltage VBG which is the output voltage of the BGR circuit 100A. On the other hand, its negative input terminal is coupled to a coupling node between the resistors R5A and R6A of the reference voltage output generating circuit 110A. The output terminal of the AMP4, outputting the reference voltage VREF, is coupled to one end of the resistor R4A of the reference voltage output generating circuit 110A.

With the above configuration, a reference voltage with extremely low temperature dependence can be output without having to provide a reference voltage output generating circuit inside the BGR circuit as with the first embodiment.

(Details of Reference Voltage Generating Circuit 10A)

The reference voltage generating circuit 10A of the second embodiment will be described in comparison with the reference voltage generating circuit 10 of the first embodiment.

Although correction current is generated using the source-type linear approximate correction current generating circuit 300 in the reference voltage generating circuit 10, the reference voltage generating circuit 10A generates the correction current using the sink-type linear approximate correction current generating circuit 300A.

Figure 7:
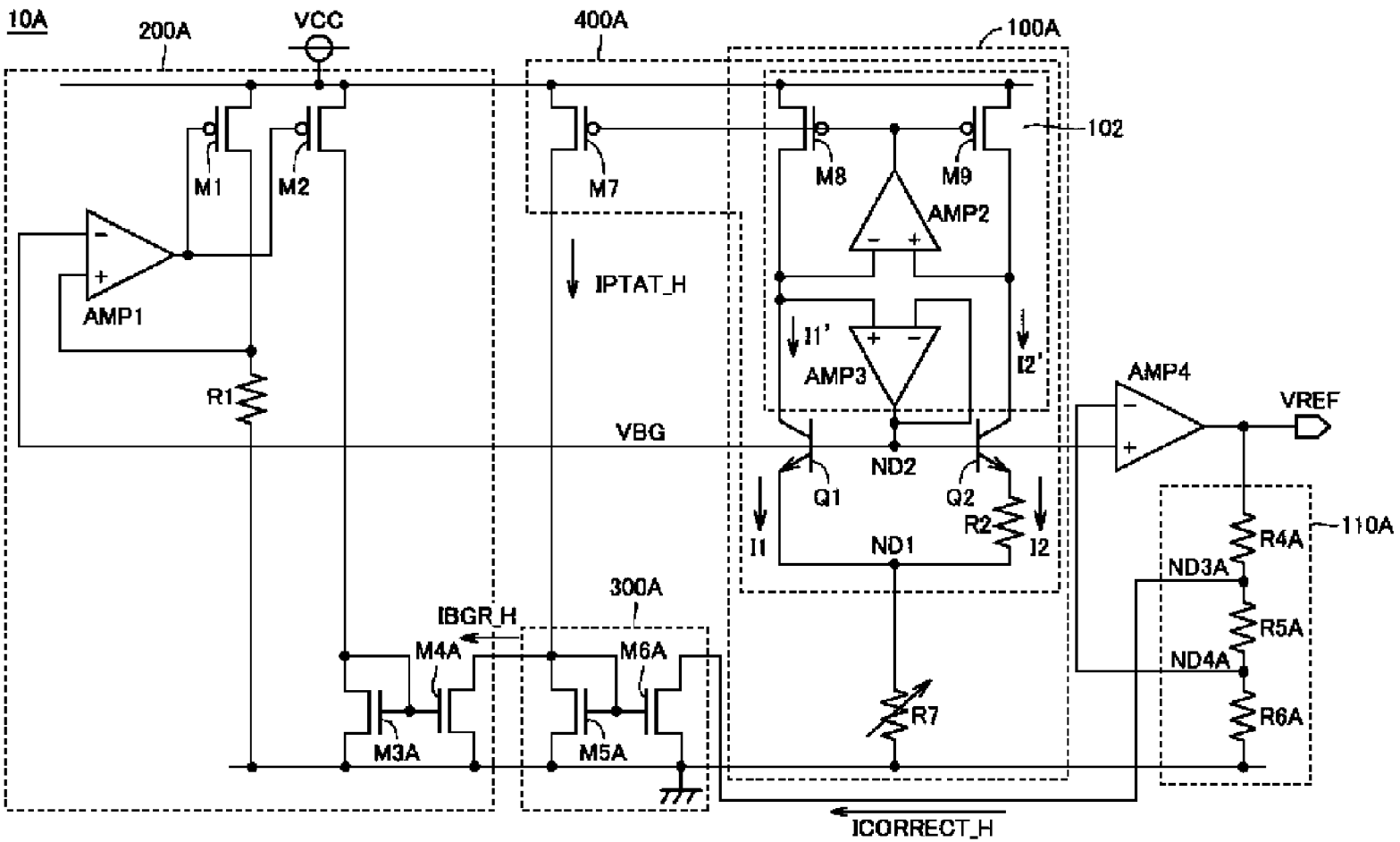
FIG. 7 shows a configuration of a reference voltage generating circuit 10A of the second embodiment.

FIG. 7 shows a configuration of the reference voltage generating circuit 10A of the second embodiment. Referring to FIG. 7, the reference voltage generating circuit 10A includes the BGR circuit 100A, the BGR current generating circuit 200A and the linear approximate correction current generating circuit 300A, the PMOS transistor M7, the AMP4, and the reference voltage output generating circuit 110A. Note that, the current source 102, the NPN-type bipolar transistors Q1 and Q2, the resistor R2, and the PMOS transistor M7 are also collectively referred to as the PTAT current generating circuit 400A.

(BGR Circuit 100A)

As shown in FIG. 7, the BGR circuit 100A has a configuration in which the node ND3 which is a coupling point with the linear approximate correction current generating circuit 300 is excluded from the configuration of the BGR circuit 100 of FIG. 3 and the resistors R3 and R4 are replaced with a resistor R7. Specifically, the BGR circuit 100A includes the current source 102, the NPN-type bipolar transistors Q1 and Q2, and the resistors R2 and R7. Note that, although the resistor R7 is supposed to be a variable resistor capable of fine adjustment of the resistance value by trimming, it need not be a variable resistor.

The current source 102 outputs the currents I1' and I2' which are of an approximately same magnitude. The current source 102 includes the PMOS transistors M8 and M9, the amplifier AMP2 which performs feedback, and the amplifier AMP3 constituting the voltage follower.

The PMOS transistors M8 and M9 constitute a current mirror circuit. The source of the PMOS transistor M8 and the source of the PMOS transistor M9 are coupled to the power source VCC. The drain of the PMOS transistor M8 is coupled to the collector terminal of the NPN-type bipolar transistor Q1. The drain of the PMOS transistor M9 is coupled to the collector terminal of the bipolar transistor Q2.

The positive input terminal of the amplifier AMP2 is coupled to the drain of the PMOS transistor M9 and the collector terminal of the bipolar transistor Q2. The negative input terminal of the amplifier AMP2 is coupled to the drain of the PMOS transistor M8 and the collector terminal of the NPN-type bipolar transistor Q1. The output terminal of the amplifier AMP2 is coupled to the gate of the PMOS transistor M8 and the gate of the PMOS transistor M9.

When the sizes of the PMOS transistors M8 and M9 are equal, the magnitudes of the current I1' transmitted from the current source 102 to the NPN-type bipolar transistor Q1 and the current I2' transmitted from the current source 102 to the bipolar transistor Q2 are made approximately equal by the amplifier AMP2.

The positive input terminal of the AMP3 is coupled to the drain of the PMOS transistor M8 and the collector terminal of the NPN-type bipolar transistor Q1. The output terminal of the amplifier AMP3 is coupled to the node ND2, and is also coupled to the negative input terminal of the amplifier AMP1

The collector terminal of the NPN-type bipolar transistor Q1 is coupled to the drain of the PMOS transistor M8, into which the current I1' flows.

The base terminal of the NPN-type bipolar transistor Q1 is coupled to the node ND2, and the emitter terminal is coupled to the node ND1.

The collector terminal of the bipolar transistor Q2 is coupled to the drain of the PMOS transistor M9, into which the current I2' flows. Note that, the currents I1 and I2 are respectively emitter currents of the bipolar transistors Q1 and Q2.

The base terminal of the bipolar transistor Q2 is coupled to the node ND2, and the emitter terminal is coupled to the resistor R2.

One end of the resistor R2 is coupled to the emitter terminal of the bipolar transistor Q2, and the other end is coupled to the node ND1.

The resistor R7 is coupled between the node ND1 and the ground. The node ND2 to which the base terminal of the NPN-type bipolar transistor Q1 and the base terminal of the bipolar transistor Q2 are coupled outputs the bandgap reference voltage VBG.

The positive input terminal of the amplifier AMP4 is coupled to the node ND2, to which the bandgap reference voltage VBG is supplied. The negative input terminal of the amplifier AMP4 is coupled to a node ND4A between the resistors R5A and R6A. The reference voltage VREF is output from the output terminal of the AMP4.

(Reference Voltage Output Generating Circuit 110A)

The reference voltage output generating circuit 110A includes the resistors R4A to R6A. The resistors R4A to R6A are coupled in series between the reference voltage VREF and the ground.

The node ND3A to which the resistors R4A and R5A are coupled is coupled to the linear approximate correction current generating circuit 300A which will be described below. In addition, the node ND4A to which the resistors R5A and R6A are coupled is coupled to the negative input terminal of the AMP4 as described above.

(BGR Current Generating Circuit 200A)

The BGR current generating circuit 200A further includes, in addition to the configuration of the BGR current generating circuit 200 of FIG. 3, NMOS transistors M3A and M4A further constituting the current mirror.

In other words, the BGR current generating circuit 200A includes the AMP1, the PMOS transistors M1 and M2, the resistor R1, and the NMOS transistors M3A and M4A.

The sources of the PMOS transistors M1 and M2 are coupled to the power source voltage VCC, and their gates receive the output of the AMP1.

The drain of the PMOS transistor M1 is coupled to one end of the resistor R1, and is also coupled to the positive input terminal of the AMP1.

The drain of the PMOS transistor M2 is coupled to the gates of the NMOS transistors M3A and M4A, and is also coupled to the drain of the NMOS transistor M3A.

The positive input terminal of the AMP1 is coupled to the drain of the PMOS transistor M1 and one end of the resistor R1. The negative input terminal of the AMP1 is coupled to the base terminals of the NPN-type bipolar transistors Q1 and Q2, to which the bandgap reference voltage VBG is supplied. The output terminal of the amplifier AMP1 is coupled to the gates of the PMOS transistors M1 and M2.

The resistor R1 is coupled between the drain of the PMOS transistor M1 and the ground. The NMOS transistor M3A has its gate and drain coupled together, with its gate being also coupled to the gate of the NMOS transistor M4A. The sources of the NMOS transistors M3A and M4A are coupled to the ground.

The drain of the NMOS transistor M4A is coupled to the gates of NMOS transistors M5A and M6A of the linear approximate correction current generating circuit 300A, and is also coupled to the drains of the NMOS transistor M5A and the PMOS transistor M7. The current IBGR_H flows into the drain of the NMOS transistor M4A via the linear approximate correction current generating circuit 300A.

(Linear Approximate Correction Current Generating Circuit 300A)

The linear approximate correction current generating circuit 300A constitutes a current mirror circuit whose transistor polarity has been changed in comparison with the linear approximate correction current generating circuit 300 of FIG. 3. Specifically, the linear approximate correction current generating circuit 300A includes the NMOS transistors M5A and M6A.

The gates of the NMOS transistors M5A and M6A, and the drain of the NMOS transistor M5A are coupled to the drain of the NMOS transistor M4A of the BGR current generating circuit 200A, and are also coupled to the drain of the PMOS transistor M7. The sources of the NMOS transistors M5A and M6A are coupled to the ground.

The drain of the NMOS transistor M6A is coupled to the node ND3A of the reference voltage output generating circuit 110A, and the correction current ICORRECT_H flows into the drain of the NMOS transistor M6A.

(PTAT Current Generating Circuit 400A)

The PTAT current generating circuit 400A includes the current source 102, the NPN-type bipolar transistors Q1 and Q2, the resistor R2, and the PMOS transistor M7.

The gate of the PMOS transistor M7 is coupled to the gates of the PMOS transistors M8 and M9, and is also coupled to the output terminal of the AMP2. The source of the PMOS transistor M7 is coupled to the power source voltage VCC, and the drain is coupled to the gates of the NMOS transistors M5A and M6A and the drain of the NMOS transistor M5A of the linear approximate correction current generating circuit 300A, and is also coupled to the drain of the NMOS transistor M4A of the BGR current generating circuit 200A. Since other components of the PTAT current generating circuit 400A are similar to those of the PTAT current generating circuit 400, repeated explanation thereof is omitted here.

Therefore, providing the configuration of the reference voltage generating circuit 10A of the second embodiment allows generation of correction voltage at the high-temperature side using the sink-type linear approximate correction current generating circuit 300A, and whereby a reference voltage VREF with extremely low temperature dependence can be output.

Since other components of the reference voltage generating circuit 10A is similar to those of the reference voltage generating circuit 10, repeated explanation thereof is omitted here.

Third Embodiment

The first and second embodiments have described a method of generating a correction voltage at the high-temperature side. With a third embodiment, a method of generating a correction voltage at the low-temperature side will be described below.

(Outline of Reference Voltage Generating Circuit 10B)

Figure 8:
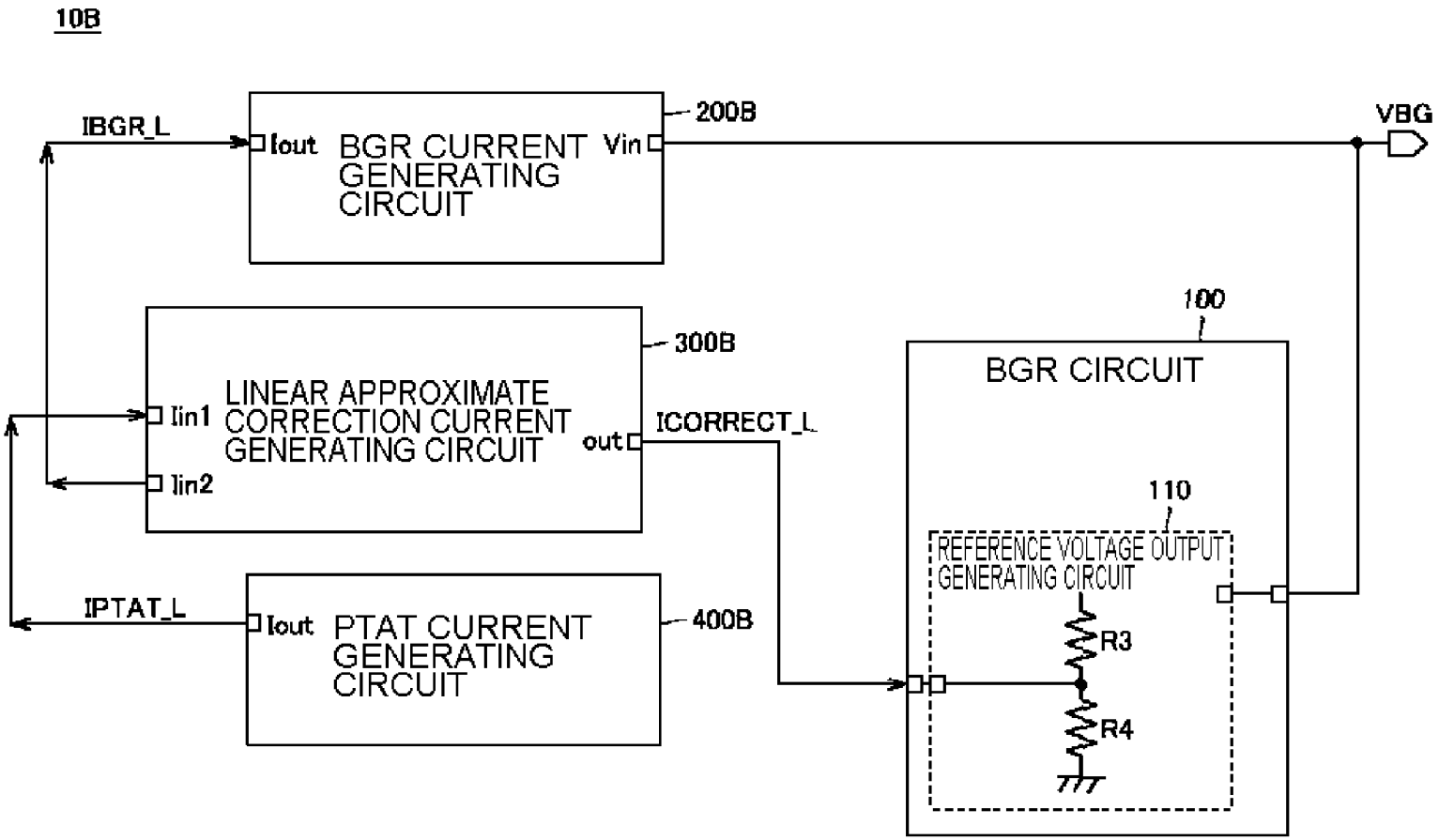
FIG. 8 outlines a configuration of a reference voltage generating circuit 10B of a third embodiment of the present invention.

FIG. 8 outlines a configuration of a reference voltage generating circuit 10B of the third embodiment of the present invention. The reference voltage generating circuit 10B will be described in comparison with the reference voltage generating circuit 10 of the first embodiment shown in FIG. 2.

Referring to FIG. 8, the reference voltage generating circuit 10B includes the BGR circuit 100, a BGR current generating circuit 200B, a linear approximate correction current generating circuit 300B, and the PTAT current generating circuit 400. Since other components of the reference voltage generating circuit 10B are similar to those of the reference voltage generating circuit 10 of the first embodiment, repeated explanation thereof is omitted here.

The terminal Vin of the BGR current generating circuit 200B receives the bandgap reference voltage VBG, and the current IBGR_L at the low-temperature side is input to the terminal Iout from the terminal Iin2 of the linear approximate correction current generating circuit 300B. The temperature dependence of the current IBGR_L is lower than the temperature dependence of the current IPTAT_L flowing out from the PTAT current generating circuit 400B.

On the other hand, the current IPTAT_L at the low-temperature side proportional to the absolute temperature is output from the terminal Iout of the PTAT current generating circuit 400B to the terminal Iin1 of the linear approximate correction current generating circuit 300B.

Comparing the current from the BGR current generating circuit 200B with the current from the PTAT current generating circuit 400B, the linear approximate correction current generating circuit 300B generates the correction current ICORRECT_L at the low-temperature side and outputs it from the terminal out to the BGR circuit 100. The correction current has a reverse characteristic with respect to the temperature characteristic of the bandgap reference voltage VBG.

The reference voltage output generating circuit 110 adds the correction voltage generated based on the correction current ICORRECT_L and the bandgap reference voltage, and outputs the result as the bandgap reference voltage VBG.

With the above configuration, a bandgap reference voltage VBG with extremely low temperature dependence can be output using a correction current not only at the high-temperature side but also at the low-temperature side.

(Details of Reference Voltage Generating Circuit 10B)

The reference voltage generating circuit 10B of the third embodiment will be described in comparison with the reference voltage generating circuit 10 of the first embodiment.

Figure 9:
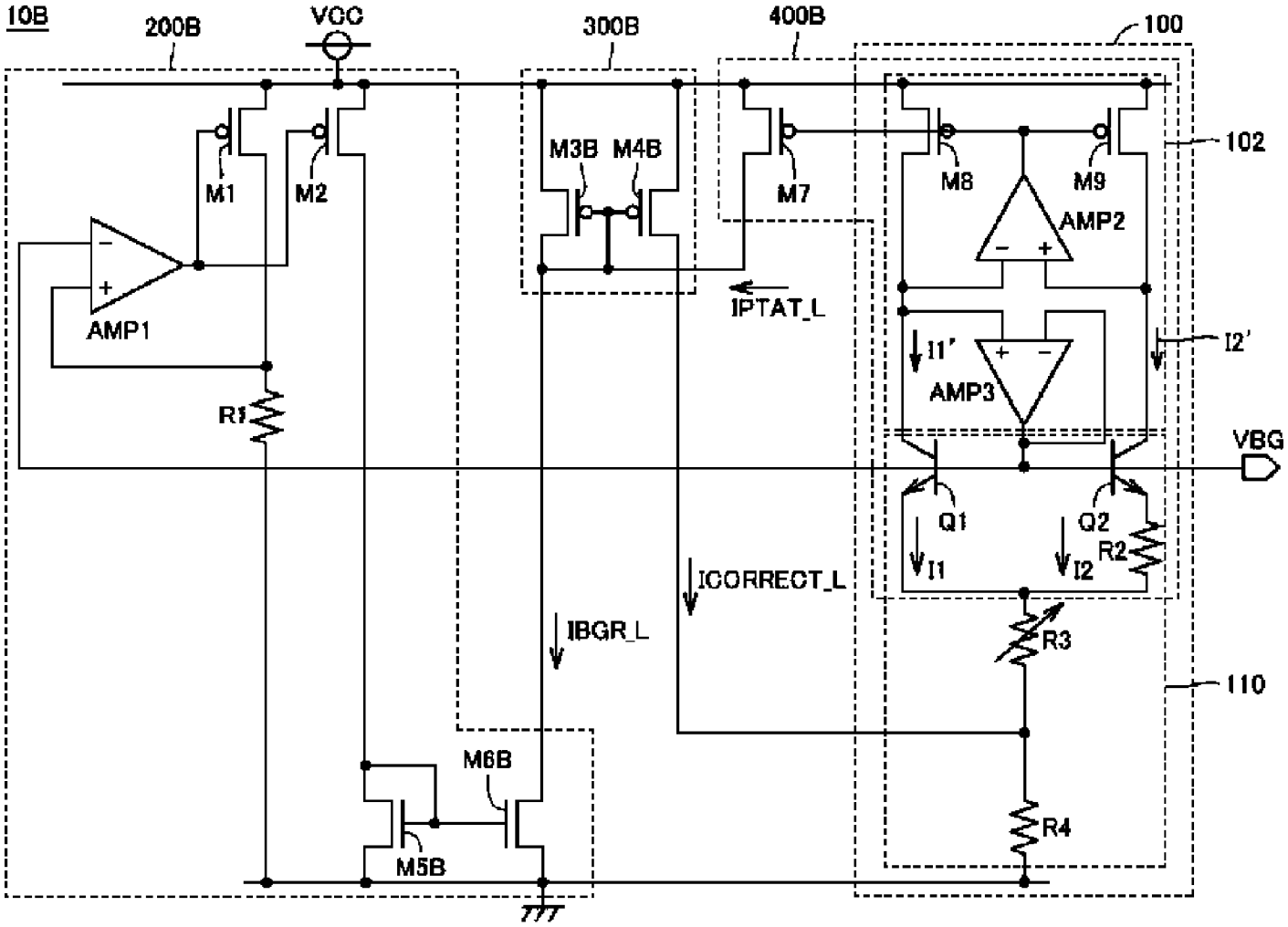
FIG. 9 shows a configuration of the reference voltage generating circuit 10B of the third embodiment.

FIG. 9 shows a configuration of the reference voltage generating circuit 10B of the third embodiment. Only the part different from the first embodiment will be explained, with the same symbol attached to the part similar to the first embodiment and the repeated explanation thereof omitted. Referring to FIG. 9, the reference voltage generating circuit 10B includes the BGR current generating circuit 200B in place of the BGR current generating circuit 200 of the reference voltage generating circuit 10.

(BGR Current Generating Circuit 200B)

The BGR current generating circuit 200B further includes, in addition to the configuration of the BGR current generating circuit 200 of the first embodiment, NMOS transistors M5B and M6B.

The NMOS transistors M5B and M6B constitute a current mirror, with the sources of the NMOS transistors M5B and M6B being coupled to the ground. In addition, the gates of the NMOS transistors M5B and M6B are coupled to the drain of the NMOS transistor M6B, and are also coupled to the drain of the PMOS transistor M2.

The drain of the NMOS transistor M6B is coupled to the drain of the PMOS transistor M3B of the linear approximate correction current generating circuit 300B, and is also coupled to the gates of the PMOS transistors M3B and M4B and the drain of the PMOS transistor M7 of the PTAT current generating circuit 400B.

(Linear Approximate Correction Current Generating Circuit 300B)

The difference from the first embodiment lies in that the correction current is generated at the low-temperature side. In other words, the BGR current IBGR_L of the BGR current generating circuit stays equal to the maximum output current value (IBGR_L_MAX) of the BGR current generating circuit until the temperature falls to a predetermined temperature (e.g., T2 of FIGS. 10A to 10C described below). This is because the PMOS transistor M7 operates in the linear region, and the PMOS transistors M3B and M4B are cut-off.

When the temperature further falls lower than the predetermined temperature (T2), the current IPTAT_L flowing out from the PTAP current generating circuit 400B becomes smaller than the maximum output current value (IBGR_L_MAX) of the BGR current generating circuit and therefore the differential current (i.e., the current obtained by subtracting the current IPTAT_L from the current IBGR_L_MAX) flows from the PMOS transistor M3B into the PMOS transistor M3B of the correction current generating circuit 300B. The PMOS transistors M3B and M4B constitute a current mirror circuit, and a current proportional to the current flowing in the PMOS transistor M3B is output from the PMOS transistor M4B to the reference voltage output generating circuit 110 as the correction current ICORRECT_L.

(Correction Current)

Figure 10A:
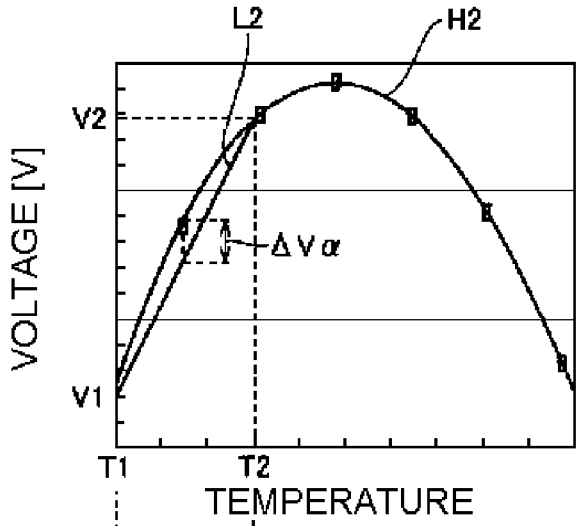
FIGS. 10A to 10C are explanatory diagrams of an operation of the reference voltage generating circuit 10B according to the third embodiment.
Figure 10B:
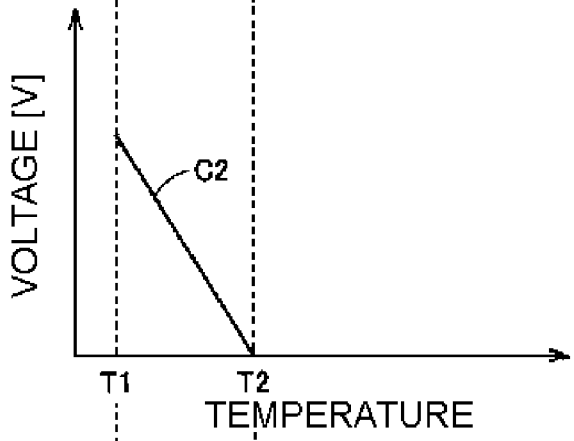
Figure 10C:
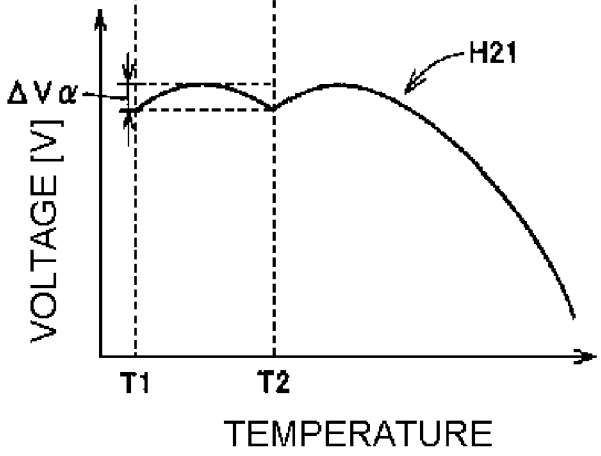

FIGS. 10A to 10C are explanatory diagrams of an operation of the reference voltage generating circuit 10B according to the third embodiment. FIG. 10A shows how the conventional bandgap reference voltage VBG varies against the temperature. As shown in FIG. 10A, the vertical axis represents the voltage [V], and the horizontal axis represents the temperature. In addition, the wave pattern H2 represents the secondary characteristic of the bandgap reference voltage VBG. The straight line L2 represents the linear approximation of the wave pattern H2 against arbitrary temperatures T1 and T2. Although not shown, the bandgap reference voltage VBG varies in a range of a few mV, according to temperature. Here, a setting of around T1=−40° C. and T2=0° C. is preferred.

The purpose of the third embodiment of the present invention is to generate a highly precise bandgap reference voltage VBG by eliminating the variation in a range of a few mV at the low-temperature side.

FIG. 10B shows a correction voltage required to reduce the temperature dependence of the bandgap reference voltage VBG.

As shown in FIG. 10B, the vertical axis represents the voltage [V] and the horizontal axis represents the temperature. In addition, the wave pattern C2 represents the correction voltage generated based on the voltage of the straight line L2 which is the linear approximation of the wave pattern H2 against the temperatures T1 to T2.

FIG. 10C shows the bandgap reference voltage of FIG. 10A with the correction voltage of FIG. 10B added thereto. As shown in FIG. 10A for the temperature range T1 to T2, whereas variation of the bandgap reference voltage against the temperature is conventionally quadratic, addition of the correction voltage causes variation of the bandgap reference voltage to decrease in the temperature range of T1 to T2, which results in reduced temperature dependence as shown in FIG. 10C. Variation of the bandgap reference voltage at this time is limited to around the potential difference $\Delta V\alpha$ between the wave pattern H2 and the straight line L2 of FIG. 10A.

Accordingly, with a configuration such as the third embodiment, variation of the bandgap reference voltage at the low-temperature side can be suppressed, and whereby a reference voltage with extremely low temperature dependence can be generated.

Since the method of generating the correction voltage is similar to that of the first embodiment, repeated explanation thereof is omitted here.

Fourth Embodiment

The first and second embodiments have described a method of generating a correction voltage at the high-temperature side. With a fourth embodiment, a method of generating a plurality of correction voltages at the high-temperature side with much higher precision will be described below.

(Outline of Reference Voltage Generating Circuit 10C)

Figure 11:
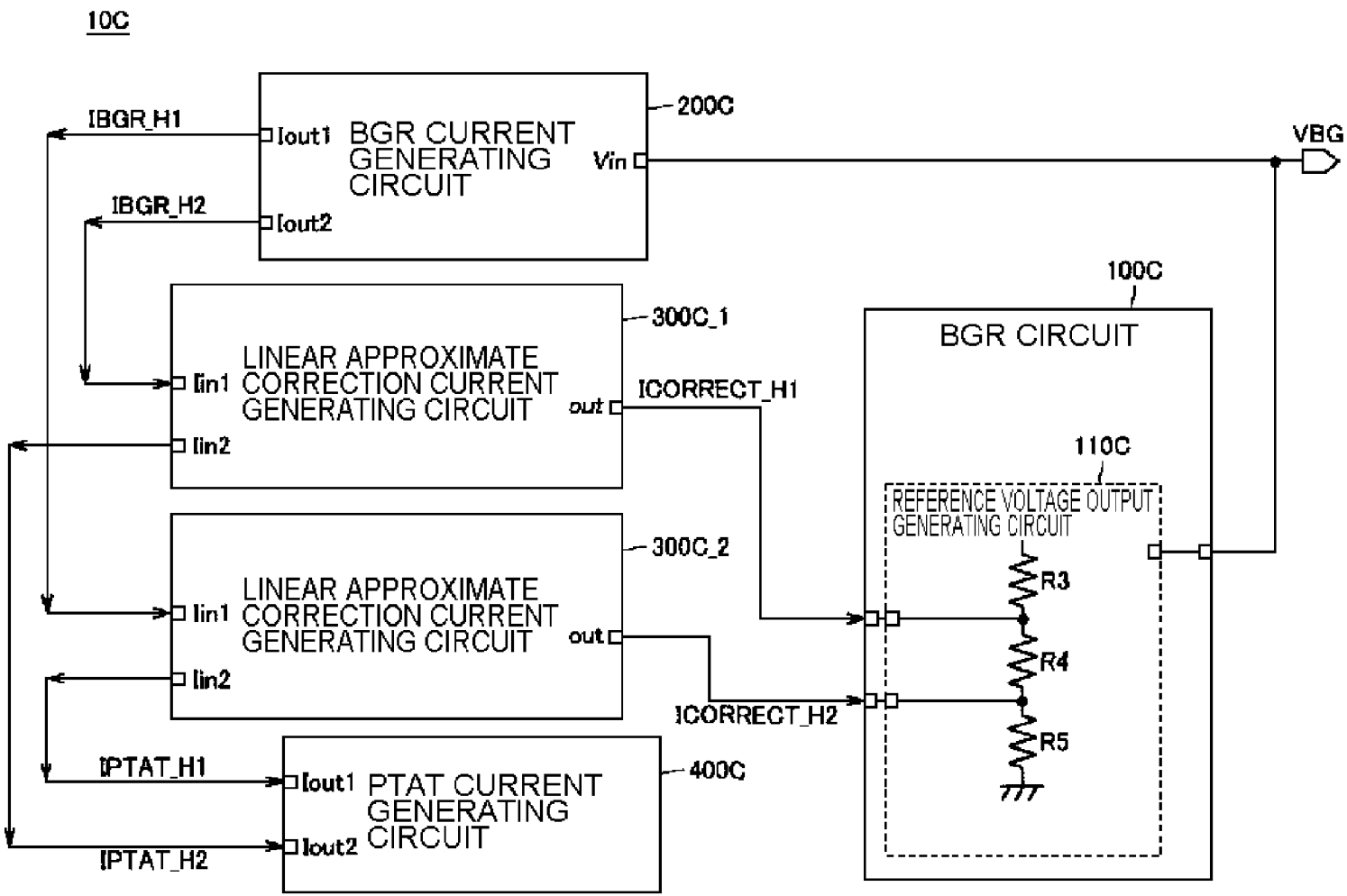
FIG. 11 outlines a configuration of a reference voltage generating circuit 10C of a fourth embodiment of the present invention.

FIG. 11 outlines a configuration of a reference voltage generating circuit 10C of the fourth embodiment of the present invention. The reference voltage generating circuit 10C will be described in comparison with the reference voltage generating circuit 10 of the first embodiment shown in FIG. 2. Here, a configuration for generating a bandgap reference voltage VBG with extremely low temperature dependence by generating correction voltages in two temperature ranges, namely, in a range from temperature T1 to temperature T2 and in a range from temperature T2 to temperature T3 will be described.

Referring to FIG. 11, the reference voltage generating circuit 10C includes a BGR circuit 100C, a BGR current generating circuit 200C, linear approximate correction current generating circuits 300C_1 and 300C_2, and a PTAT current generating circuit 400C. The BGR circuit 100C includes a reference voltage output generating circuit 110C. The reference voltage output generating circuit 110C includes the resistors R3 to R5.

The BGR current generating circuit 200C receives the bandgap reference voltage VBG at the terminal Vin, and generates the currents IBGR_H1 and IBGR_H2 at the high-temperature side. The currents IBGR_H1, and IBGR_H2 are respectively output from the terminals Iout1 and Iout2 to the linear approximate correction current generating circuits 300C_1 and 300C_2. The current IBGR_H1 is configured to be clamped at a predetermined current value (IBGR_H1_MAX) when a predetermined temperature (e.g., T1 of FIGS. 13A to 13C) is reached, as described below, with the temperature dependence of the current value (IBGR_H1_MAX) being smaller than the temperature dependence of the current IPTAT_H1 flowing into the PTAT current generating circuit 400C. In addition, the current IBGR_H2 is configured to be clamped at a predetermined current value (IBGR_H2_MAX) when a predetermined temperature (e.g., T2 of FIGS. 13A to 13C) is reached, as will be described below, with the temperature dependence of the current value (IBGR_H2_MAX) being smaller than the temperature dependence of the current IPTAT_H2 flowing into the PTAT current generating circuit 400C.

On the other hand, each terminal Iin2 of the linear approximate correction current generating circuits 300C_1 and 300C_2 outputs, to the PTAT current generating circuit 400C, the currents IPTAT_H1 and IPTAT_H2 which are respectively proportional to the absolute temperature.

The linear approximate correction current generating circuit 300C_1 compares the current from the BGR current generating circuit 200C and the current from the PTAT current generating circuit 400C, and whereby the correction current ICORRECT_H1 at the high-temperature side is generated and output from the terminal out to the BGR circuit 100C.

The linear approximate correction current generating circuit 300C_2 compares the current from the BGR current generating circuit 200C and the current from the PTAT current generating circuit 400C, and whereby the correction current ICORRECT_H2 at the high-temperature side is generated and output from the terminal out to the BGR circuit 100C.

The reference voltage output generating circuit 110C adds the correction voltage generated based on the correction currents ICORRECT_H1 and ICORRECT_H2 to the bandgap reference voltage, and outputs the result as the bandgap reference voltage VBG.

The reference voltage output generating circuit 110C includes a plurality of resistors R3 to R5, the resistors R3 to R5 being coupled in series between the bandgap reference voltage VBG and the ground. The correction current ICORRECT_H1 described above is coupled to the coupling node between the resistors R3 and R4. The correction current ICORRECT_H2 described above is coupled to the coupling node between the resistors R4 and R5.

With the above configuration, a bandgap reference voltage VBG with extremely low temperature dependence can be output using a plurality of correction voltages at the high-temperature side.

(Details of Reference Voltage Generating Circuit 10C)

The reference voltage generating circuit 10C of the fourth embodiment will be described in comparison with the reference voltage generating circuit 10 of the first embodiment.

Figure 12:
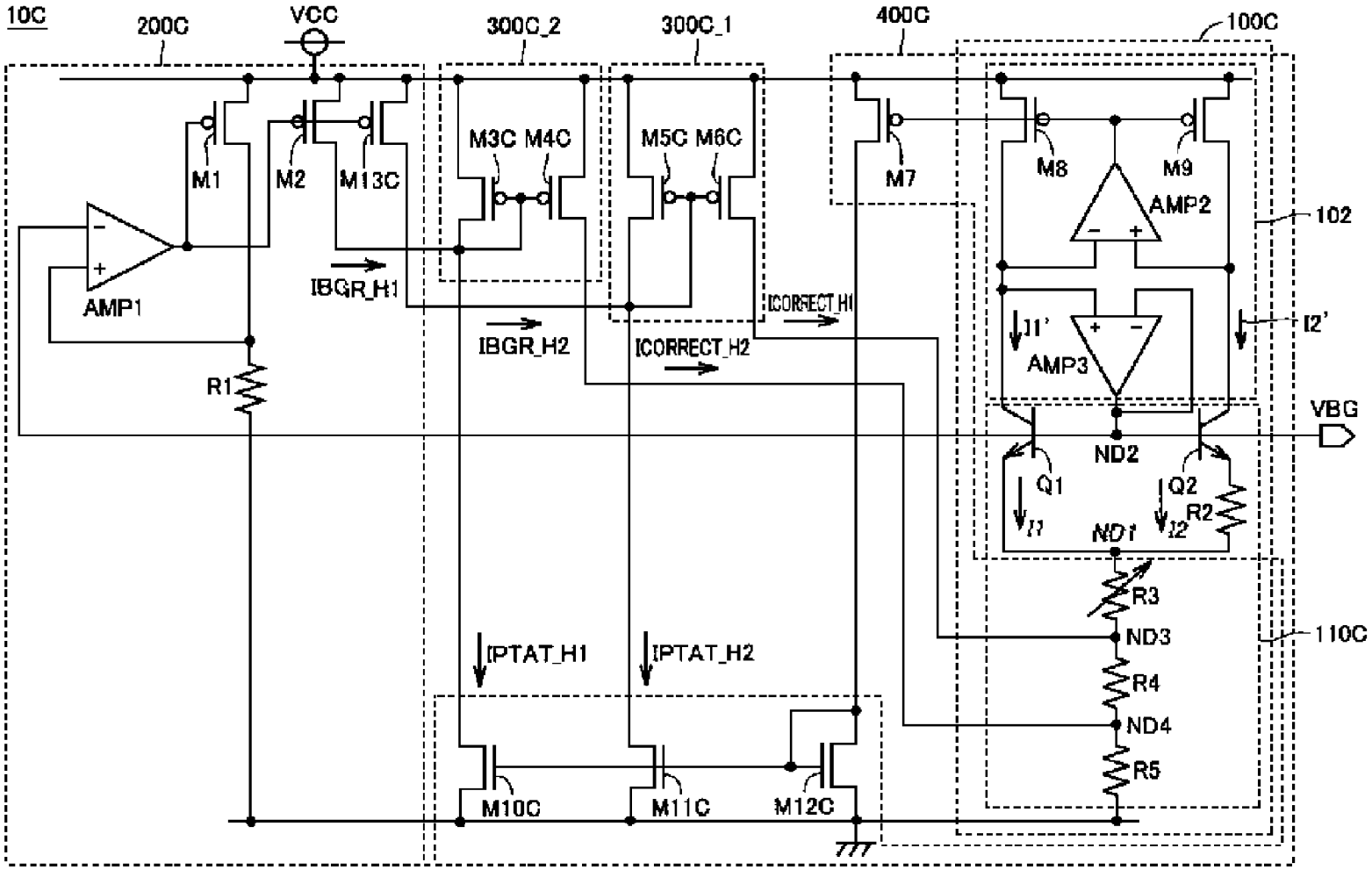
FIG. 12 shows a configuration of the reference voltage generating circuit 10C of the fourth embodiment.

FIG. 12 shows a configuration of the reference voltage generating circuit 10C of the fourth embodiment. Only the part different from the first embodiment will be explained, with the same symbol attached to the part similar to the first embodiment and the repeated explanation thereof omitted.

Referring to FIG. 12, the reference voltage generating circuit 10C includes the BGR circuit 100C, the BGR current generating circuit 200C, the linear approximate correction current generating circuits 300C_1 and 300C_2, the PMOS transistor M7, and NMOS transistors M10C to M12C. Here, the current source 102, the NPN-type bipolar transistors Q1 and Q2, the resistor R2, the PMOS transistor M7, and the NMOS transistors M10C to M12C are also collectively referred to as the PTAT current generating circuit 400C.

(BGR Circuit 100C)

As shown in FIG. 12, the BGR circuit 100C includes the current source 102 and the reference voltage output generating circuit 110C.

The reference voltage output generating circuit 110C includes the NPN-type bipolar transistors Q1 and Q2, and the resistors R2 to R5.

The resistors R3 to R5 are coupled in series and provided between the node ND1 and the ground. The node ND3 to which the resistors R3 and R4 are coupled is coupled to the drain of a PMOS transistor M6C of the linear approximate correction current generating circuit 300C_1.

In addition, the node ND4 to which the resistors R4 and R5 are coupled is coupled to the drain of a PMOS transistor M4C of the linear approximate correction current generating circuit 300C_2. The drain of the PMOS transistor M6C may be coupled to the node ND4, the drain of the PMOS transistor M4C may be coupled to the node ND3, or the drains of the PMOS transistors M4C and M6C may both be coupled to ND3 or ND4.

(BGR Current Generating Circuit 200C)

The BGR current generating circuit 200C further includes the PMOS transistor M13C, in addition to the configuration of the BGR current generating circuit 200.

The sources of the PMOS transistors M1, M2, and M13C are coupled to the power source voltage VCC, and their gates receive the output of the AMP1.

The drain of the PMOS transistor M1 is coupled to one end of the resistor R1, and is also coupled to the positive input terminal of the AMP1.

The drain of the PMOS transistor M2 is coupled to the gates of the PMOS transistors M3C and M4C of the linear approximate correction current generating circuit 300C_2, and is also coupled to the drain of the PMOS transistor M3C and the drain of the NMOS transistor M10C of the PTAT current generating circuit 400C.

The drain of the PMOS transistor M3C is coupled to the gates of the PMOS transistors M5C and M6C of the linear approximate correction current generating circuit 300C_1, and is also coupled to the drain of PMOS transistor M5C and the drain of the NMOS transistor M11C of the PTAT current generating circuit 400C.

The positive input terminal of the AMP1 is coupled to the drain of the PMOS transistor M1 and one end of the resistor R1. The negative input terminal of the AMP1 is coupled to the base terminals of the NPN-type bipolar transistors Q1 and Q2. The output terminal of the amplifier AMP3 is coupled to the gates of the PMOS transistors M1 and M2.

The resistor R1 is coupled between the drain of the PMOS transistor M1 and the ground.

(Linear Approximate Correction Current Generating Circuits 300C_1 and 300C_2)

The linear approximate correction current generating circuits 300C_1 and 300C_2 have the same configuration as that of the linear approximate correction current generating circuit 300 of the first embodiment and also of a source-type, but are different in its coupling relation. In other words, to the gates of the PMOS transistors M3C and M4C of the linear approximate correction current generating circuit 300C_2, the drain of the PMOS transistor M2 of the BGR current generating circuit 200C is coupled. In addition, to the gates of the PMOS transistors M5C and M6C of the linear approximate correction current generating circuit 300C_1, the drain of the PMOS transistor M3C of the BGR current generating circuit 200C is coupled.

The drains of the PMOS transistors M4C and M6C of the linear approximate correction current generating circuits 300C_1 and 300C_2 are respectively coupled to the nodes ND3 and ND4 of the reference voltage output generating circuit 110C.

(PTAT Current Generating Circuit 400C)

The PTAT current generating circuit 400 includes the current source 102, the NPN-type bipolar transistors Q1 and Q2, the resistor R2, the PMOS transistor M7, and the NMOS transistors M10C to M12C.

The PMOS transistors M7 to M9 and the NMOS transistors M10C to M12C respectively constitute current mirror circuits.

Specifically, the sources of the PMOS transistors M7 to M9 have the power source voltage VCC supplied thereto, and their gates are coupled to the output terminal of the AMP2. The drain of the PMOS transistor M7 is coupled to the gates of the NMOS transistors M10C to M12C, and is also coupled to the drain of the NMOS transistor M12C.

On the other hand, the sources of the NMOS transistors M10C to M12C are coupled to the ground, and their gates are coupled to the drain of the PMOS transistor M7, and are also coupled to the drain of the NMOS transistor M12C.

The drain of the NMOS transistor M10C is coupled to the gates of the PMOS transistors M3C and M4C of the linear approximate correction current generating circuit 300C_2, and is also coupled to the drain of the PMOS transistor M3C.

Furthermore, the drain of the NMOS transistor M10C is also coupled to the drain of the PMOS transistor M2 of the BGR current generating circuit 200C.

The drain of the NMOS transistor M11C is coupled to the gates of the PMOS transistors M5C and M6C of the linear approximate correction current generating circuit 300C_1, and is also coupled to the drain of the PMOS transistor M5C. Furthermore, the drain of the NMOS transistor M11C is also coupled to the drain of the PMOS transistor M13C of the BGR current generating circuit 200C.

The drain of the NMOS transistor M12C is coupled to the gates of the NMOS transistors M10C to M12C, and is also coupled to the drain of the PMOS transistor M7.

(Correction Current)

Figure 13A:
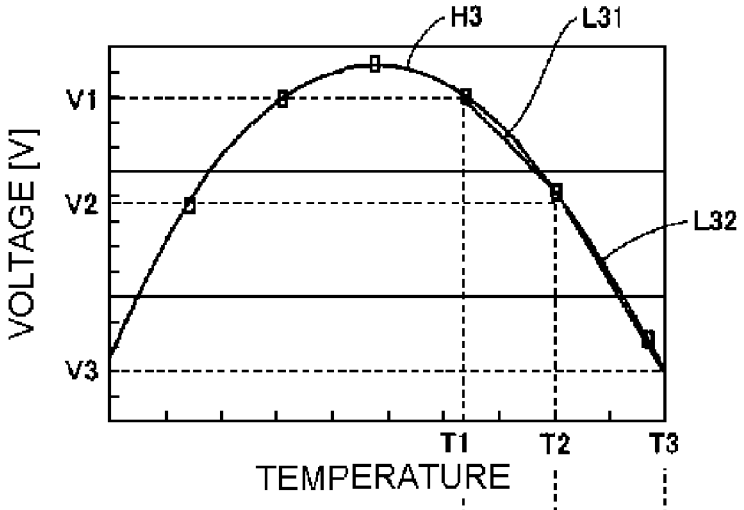
FIGS. 13A to 13C are explanatory diagrams of an operation of the reference voltage generating circuit 10C according to the fourth embodiment.
Figure 13B:
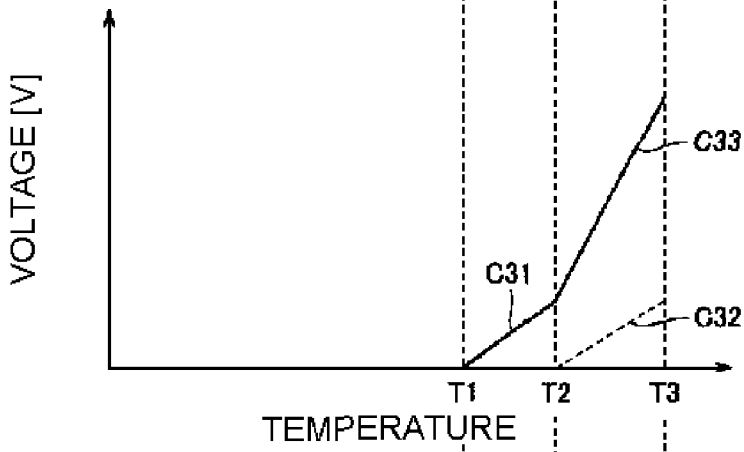
Figure 13C:
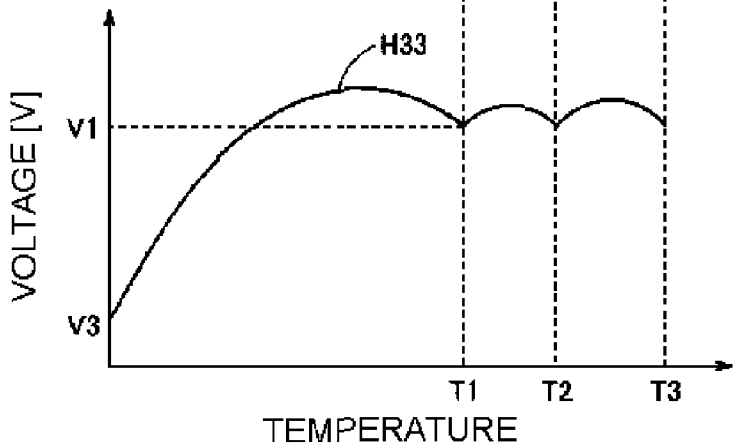

FIGS. 13A to 13C are explanatory diagrams of an operation of the reference voltage generating circuit 10C according to the fourth embodiment. FIG. 13A shows how the conventional bandgap reference voltage VBG varies against the temperature. As shown in FIG. 13A, the vertical axis represents the voltage [V], and the horizontal axis represents temperature. In addition, the wave pattern H3 represents the secondary characteristic of the bandgap reference voltage VBG. The straight lines L31 and L32 represent the linear approximation of the wave pattern H3 against the temperatures T1 to T2, and the temperatures T2 to T3, respectively. Here, a setting of around T1=60° C., T2=100° C., and T3=140° C. is preferred to effectively suppress variation of the bandgap voltage.

The purpose of the fourth embodiment of the present invention is to generate a highly precise bandgap reference voltage VBG by similarly eliminating variation of the bandgap reference voltage in a range of a few mV at the high-temperature side in comparison with the first embodiment.

FIG. 13B shows a correction voltage required to prevent the bandgap reference voltage VBG from varying according to the temperature.

As shown in FIG. 13B, the vertical axis represents the voltage [V] and the horizontal axis represents the temperature. In addition, the wave pattern C31 represents the correction voltage generated based on the voltage of the straight line L31 which is the linear approximation of the wave pattern H3 against temperatures T1 to T2. In addition, the wave pattern C32 represents the correction voltage generated based on the voltage of the straight line L32 which is the linear approximation of the wave pattern H3 against the temperatures T2 to T3. The wave pattern C33 represents the substantial correction voltage between the temperatures T2 and T3. The wave pattern C33 indicates the value obtained by adding, to the correction voltage indicated by the wave pattern C32, a correction voltage for the range of T2 to T3 which has been corrected base on the wave pattern C31.

FIG. 13C shows the bandgap reference voltage of FIG. 13A with the correction voltage of FIG. 13B added thereto. As shown in FIG. 13A for the temperature range T1 to T2 and the temperature range T2 to T3, whereas variation of the bandgap reference voltage against the temperature is conventionally quadratic, addition of the correction voltage causes variation of the bandgap reference voltage to decrease in the temperature range of T1 to T2 and the temperature range of T2 to T3, which results in extremely low temperature dependence as shown in FIG. 13C.

Accordingly, with a configuration such as the fourth embodiment, variation of the bandgap reference voltage at the high-temperature side can be suppressed, and whereby a reference voltage with extremely low temperature dependence can be generated.

Since the method of generating the correction voltage is similar to the first embodiment, repeated explanation thereof is omitted here.

Fifth Embodiment

Outline of Reference Voltage Generating Circuit 10D

Figure 14:
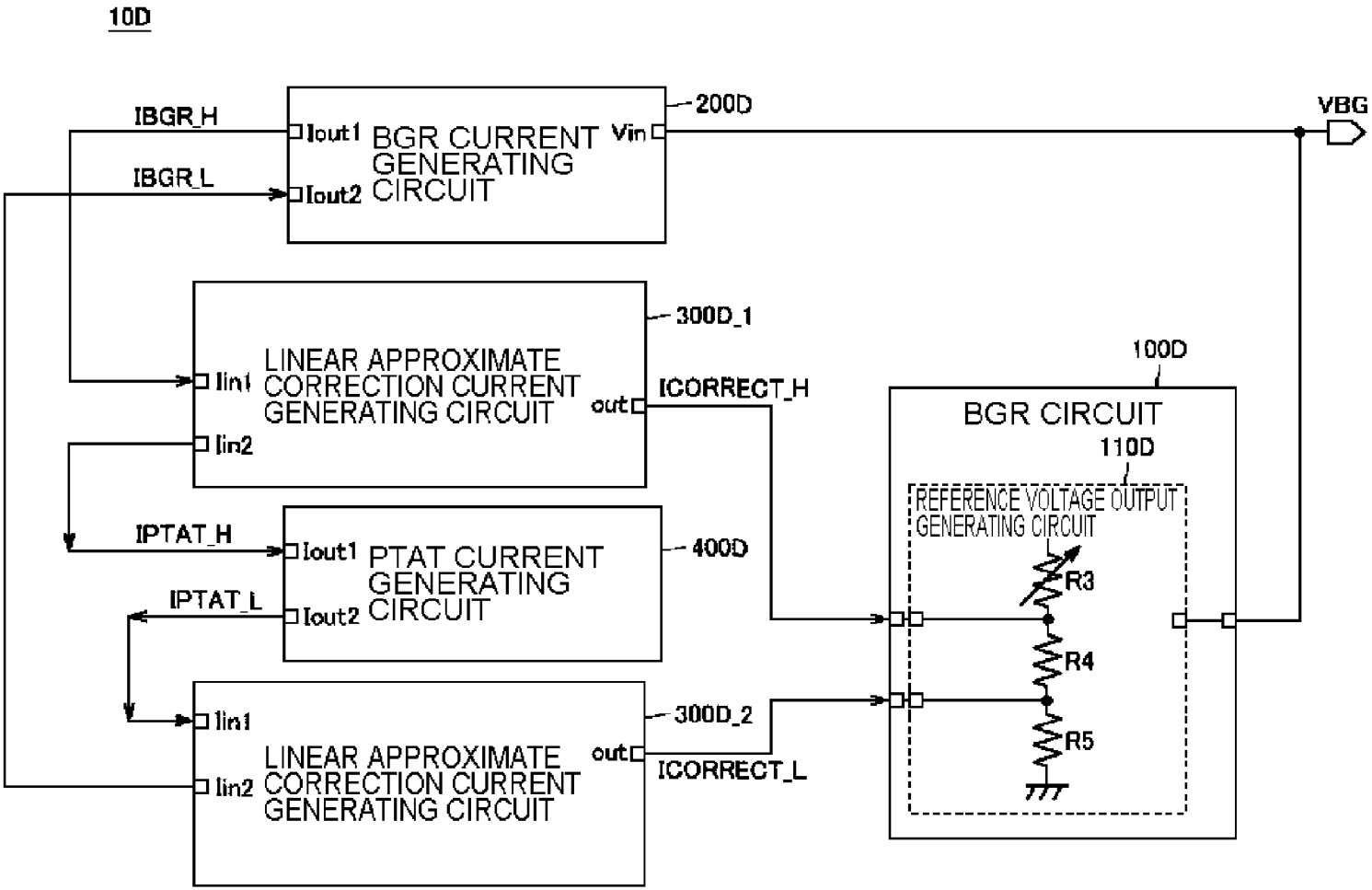
FIG. 14 outlines a configuration of a reference voltage generating circuit 10D of a fifth embodiment of the present invention.

FIG. 14 outlines a configuration of a reference voltage generating circuit 10D of a fifth embodiment of the present invention. The reference voltage generating circuit 10D of the fifth embodiment is a combined embodiment sharing common parts of the reference voltage generating circuit 10 of the first embodiment and the reference voltage generating circuit 10B of the third embodiment. The reference voltage generating circuit 10D will be described in comparison with the first and third embodiments.

The reference voltage generating circuit 10D of the fifth embodiment uses the correction voltages respectively at the high-temperature side and the low-temperature side of the bandgap reference voltage VBG to generate a bandgap reference voltage VBG with extremely low temperature dependence. Here, a configuration will be described in which correction is made in temperatures from T1 to T2 at the low-temperature side and in temperatures from T3 to T4 at the high-temperature side to generate a bandgap reference voltage VBG with low temperature dependence.

Referring to FIG. 14, the reference voltage generating circuit 10D includes a BGR circuit 100D, a BGR current generating circuit 200D, linear approximate correction current generating circuits 300D_1 and 300D_2, and a PTAT current generating circuit 400D. The BGR circuit 100D includes a reference voltage output generating circuit 110D. The reference voltage output generating circuit 110D includes the resistors R3 to R5.

The BGR current generating circuit 200D receives the bandgap reference voltage VBG at the terminal Vin, and generates the current IBGR_H1 at the high-temperature side and the current IBGR_L at the low-temperature side. The currents IBGR_H and IBGR_L are respectively output to the linear approximate correction current generating circuits 300D_1 and 300D_2 from the terminals Iout1 and Iout2.

On the other hand, the terminal Iin2 of the linear approximate correction current generating circuit 300D_1 outputs, to the PTAT current generating circuit 400D, the current IPTAT_H which is proportional to the absolute temperature. The terminal Iin1 of the linear approximate correction current generating circuit 300D_2 receives, from the PTAT current generating circuit 400D, the current IPTAT_L at the low-temperature side which is proportional to the absolute temperature.

The linear approximate correction current generating circuit 300D_1 compares the current from the BGR current generating circuit 200D and the current from the PTAT current generating circuit 400D, and whereby the correction current ICORRECT_H at the high-temperature side is generated and output from the terminal out to the BGR circuit 100D.

The linear approximate correction current generating circuit 300D_2 compares the current from the BGR current generating circuit 200D and the current from the PTAT current generating circuit 400D, and whereby the correction current ICORRECT_L at the low-temperature side is generated and output from the terminal out to the BGR circuit 100D.

The reference voltage output generating circuit 110D adds the correction voltage generated based on the correction currents ICORRECT_H and ICORRECT_L to the bandgap reference voltage, and outputs the result as the bandgap reference voltage VBG.

The reference voltage output generating circuit 110D includes the resistors R3 to R5, which are coupled in series between the bandgap reference voltage VBG and the ground. The correction current ICORRECT_H described above is coupled to the coupling node between the resistors R3 and R4. The correction current ICORRECT_L described above is coupled to the coupling node between the resistors R4 and R5.

With the above configuration, a highly precise bandgap reference voltage VBG with extremely low temperature dependence can be output using correction voltages at both the high-temperature side and the low-temperature side.

(Details of Reference Voltage Generating Circuit 10D)

The reference voltage generating circuit 10D of the fifth embodiment will be described in comparison with the reference voltage generating circuit 10 of the first embodiment.

Figure 15:
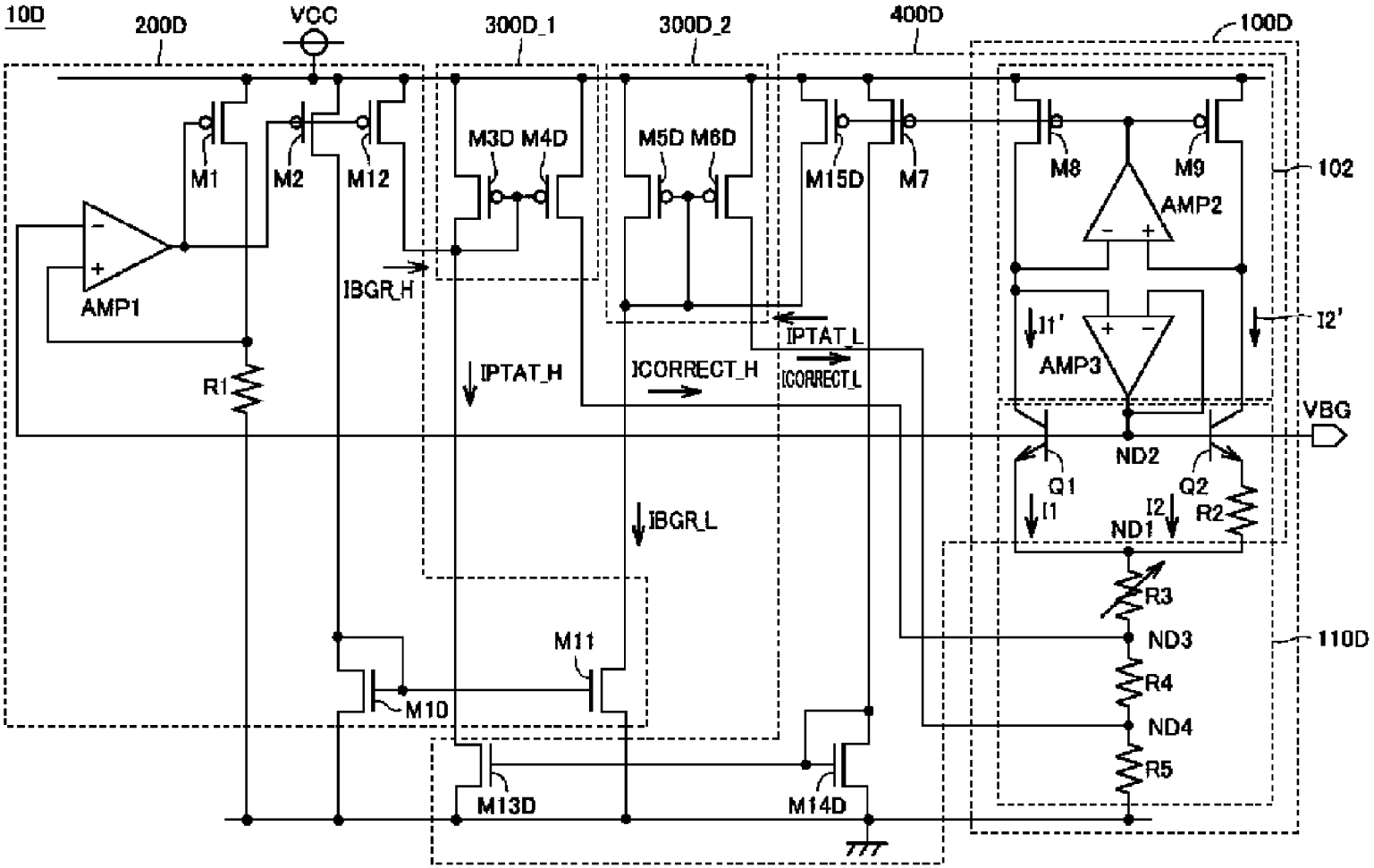
FIG. 15 shows a configuration of the reference voltage generating circuit 10D of the fifth embodiment.

FIG. 15 shows a configuration of the reference voltage generating circuit 10D of the fifth embodiment. Only the part different from the reference voltage generating circuit 10 of the first embodiment will be explained, with the same symbol attached to the part similar to the reference voltage generating circuit 10 of the first embodiment and the repeated explanation thereof omitted.

Referring to FIG. 15, the reference voltage generating circuit 10D includes the BGR circuit 100D, the BGR current generating circuit 200D, and the linear approximate correction current generating circuits 300D_1 and 300D_2, PMOS transistors M7 and M15D, and NMOS transistors M13D and M14D. Here, the current source 102, the NPN-type bipolar transistors Q1 and Q2, the resistor R2, the PMOS transistors M7 and M15D, and the NMOS transistors M13D and M14D are also collectively referred to as the PTAT current generating circuit 400D.

(BGR Circuit 100D)

As shown in FIG. 15, the BGR circuit 100D includes the current source 102 and the reference voltage output generating circuit 110D.

The reference voltage output generating circuit 110D includes the NPN-type bipolar transistors Q1 and Q2, and the resistors R2 to R5.

The resistors R3 to R5 are coupled in series and provided between the node ND1 and the ground. The node ND4 having the resistors R4 and R5 coupled thereto is coupled to the drain of PMOS transistor M6D of the linear approximate correction current generating circuit 300D_2.

In addition, the node ND3 to which the resistors R3 and R4 are coupled is coupled to the drain of the PMOS transistor M4D of the linear approximate correction current generating circuit 300D_1. According to the temperature setting that causes the compensation currents at the high-temperature side and the low-temperature side to start flowing, the drain of the PMOS transistor M6D may be coupled to the node ND3 and the drain of the PMOS transistor M4D may be coupled to the node ND4, or the drains of the PMOS transistors M4D and M6D may both be coupled to the node ND3 or the node ND4.

(BGR Current Generating Circuit 200D)

The BGR current generating circuit 200D further includes, in addition to the configuration of the BGR current generating circuit 200, a PMOS transistor M12 and NMOS transistors M10 and M11. The PMOS transistor M12 corresponds to the PMOS transistor M2 of the first embodiment (FIG. 3), and the NMOS transistors M10 and M11 are respectively equivalent to the NMOS transistors M5B and M6B of the third embodiment (FIG. 9).

The sources of the PMOS transistors M1, M2, and M12 are coupled to the power source voltage VCC, and their gates receive the output of the AMP1.

The drain of the PMOS transistor M1 is coupled to one end of the resistor R1, and is also coupled to the positive input terminal of the AMP1.

The drain of the PMOS transistor M2 is coupled to the drain of the NMOS transistor M10, and is also coupled to the gates of the NMOS transistors M10 and M11.

The drain of the PMOS transistor M12 is coupled to the gates of the PMOS transistors M3D and M4D of the linear approximate correction current generating circuit 300D_1, and is also coupled to the drain of the PMOS transistor M3D and the drain of the NMOS transistor M13D of the PTAT current generating circuit 400D.

The positive input terminal of the AMP1 is coupled to the drain of the PMOS transistor M1 and one end of the resistor R1. The negative input terminal of the AMP1 is coupled to the base terminals of the NPN-type bipolar transistors Q1 and Q2. The output terminal of the amplifier AMP1 is coupled to the gates of the PMOS transistors M1, M2, and M12.

The resistor R1 is coupled between the drain of the PMOS transistor M1 and the ground. The gates of the NMOS transistors M10 and M11 are coupled to the drain of the PMOS transistor M2, and are also coupled to the drain of the NMOS transistor M10. The sources of the NMOS transistors M10 and M11 are coupled to the ground. The drain of the NMOS transistor M11 is coupled to the drain of PMOS transistor M5D of the linear approximate correction current generating circuit 300D_2, and is also coupled to the gates of the PMOS transistors M5D and M6D.

(Linear Approximate Correction Current Generating Circuits 300D_1 and 300D_2)

The linear approximate correction current generating circuits 300D_1 and 300D_2 are respectively equivalent to the configuration of the linear approximate correction current generating circuit 300 of the first embodiment (FIG. 3) and the linear approximate correction current generating circuit 300B of the third embodiment (FIG. 9).

Specifically, the gates of the PMOS transistors M3D and M4D of the linear approximate correction current generating circuit 300D_1 are coupled to the drain of the PMOS transistor M12 of the BGR current generating circuit 200D, and are also coupled to the drain of the PMOS transistor M3D.

In addition, the gates of the PMOS transistor M5D and M6D of the linear approximate correction current generating circuit 300D_2 are coupled to the drain of the NMOS transistor M11 of the BGR current generating circuit 200D, and are also coupled to the drain of the PMOS transistor M5D, and are also coupled to the drain of the PMOS transistor M15D of the IPTAT current generating circuit 400D. In addition, the sources of the PMOS transistors M3D to M6D are coupled to the power source voltage VCC.

The drain of the PMOS transistor M4D of the linear approximate correction current generating circuit 300D_1 is coupled to the node ND3 of the reference voltage output generating circuit 110D, and whereby the bandgap reference voltage VBG at the high-temperature side is corrected.

On the other hand, the drain of the PMOS transistor M6D of the linear approximate correction current generating circuit 300D_2 is coupled to the node ND4 of the reference voltage output generating circuit 110D, and whereby the bandgap reference voltage VBG at the low-temperature side is corrected.

(PTAT Current Generating Circuit 400D)

The PTAT current generating circuit 400D includes the current source 102, the NPN-type bipolar transistors Q1 and Q2, the resistor R2, the PMOS transistors M7 and M15D, and NMOS transistors M13D and M14D. The PMOS transistor M15D corresponds to the PMOS transistor M7 of the third embodiment (FIG. 9), and the NMOS transistors M13D and M14D correspond to the NMOS transistors M5 and M6 of the first embodiment (FIG. 3).

The PMOS transistors M7 to M9, and M15D, and the NMOS transistors M13D and M14D respectively constitute current mirror circuits.

Specifically, the sources of the PMOS transistors M7 to M9, and M15D have the power source voltage VCC supplied thereto, and their gates are coupled to the output terminal of the AMP2. The drain of the PMOS transistor M7 is coupled to the gates of the NMOS transistors M13D and M14D, and is also coupled to the drain of the NMOS transistor M14D. The drain of the PMOS transistor M15D is coupled to the gates of the PMOS transistors M5D and M6D, and is also coupled to the drain of the PMOS transistor M5D and the drain of the NMOS transistor M11.

On the other hand, the sources of the NMOS transistors M13D and M14D are coupled to the ground, and their gates are coupled to the drain of the PMOS transistor M7, and are coupled to the drain of the NMOS transistor M14D.

The drain of the NMOS transistor M13D is coupled to the gates of the PMOS transistors M3D and M4D of the linear approximate correction current generating circuit 300D_1, and is also coupled to the drain of the PMOS transistor M3D. Furthermore, the drain of the NMOS transistor M13D is coupled to the drain of the PMOS transistor M12 of the BGR current generating circuit 200D.

The drain of the NMOS transistor M14D is coupled to the gates of the NMOS transistors M13D to M14D, and is also coupled to the drain of the PMOS transistor M7.

(Correction Current)

Figure 16:
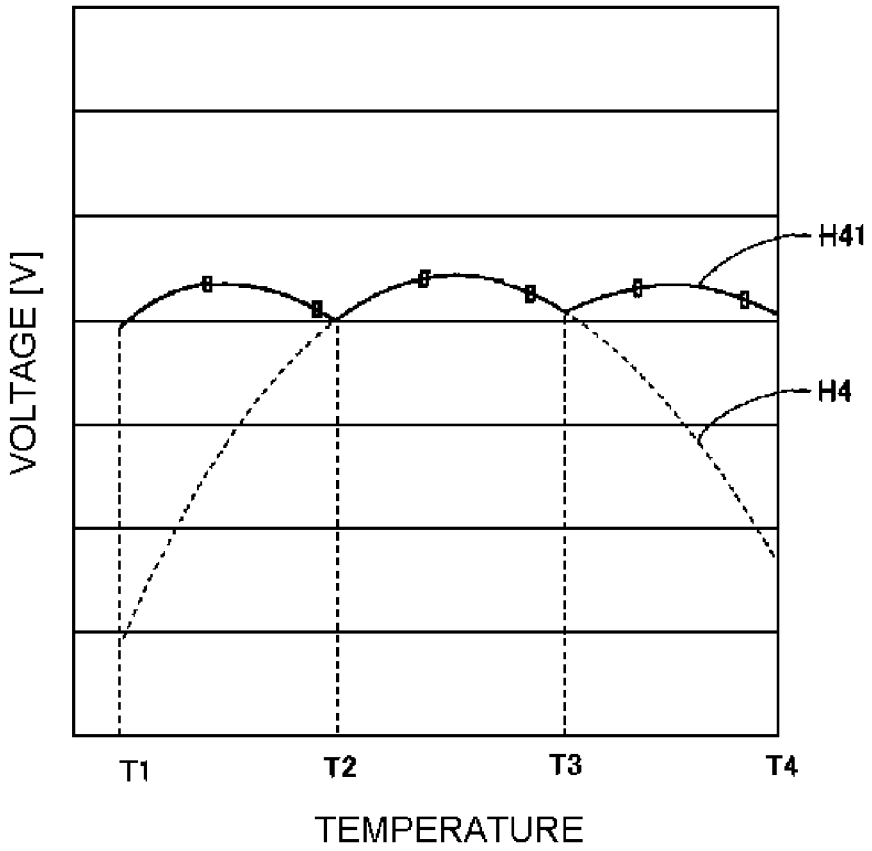
FIG. 16 shows the result of a bandgap reference voltage VBG by the reference voltage generating circuit 10D of the fifth embodiment.

FIG. 16 shows the result of the bandgap reference voltage VBG by the reference voltage generating circuit 10D of the fifth embodiment. Referring to FIG. 16, the vertical axis represents the voltage [V] and the horizontal axis represents temperature. In addition, the wave pattern H4 represents the secondary characteristic of the bandgap reference voltage VBG. The Wave pattern H41 represents the secondary characteristic of the bandgap reference voltage VBG which has been corrected by the correction voltage against the temperatures T1 to T2 and the temperatures T3 to T4.

As shown in FIG. 16, the temperature dependence of the wave pattern H41 representing the bandgap reference voltage VBG after correction becomes lower than the temperature dependence of the wave pattern H4 representing the bandgap reference voltage VBG before correction, both at the high-temperature side and the low-temperature side.

Sixth Embodiment

Base Current Compensation Circuit

Figure 17:
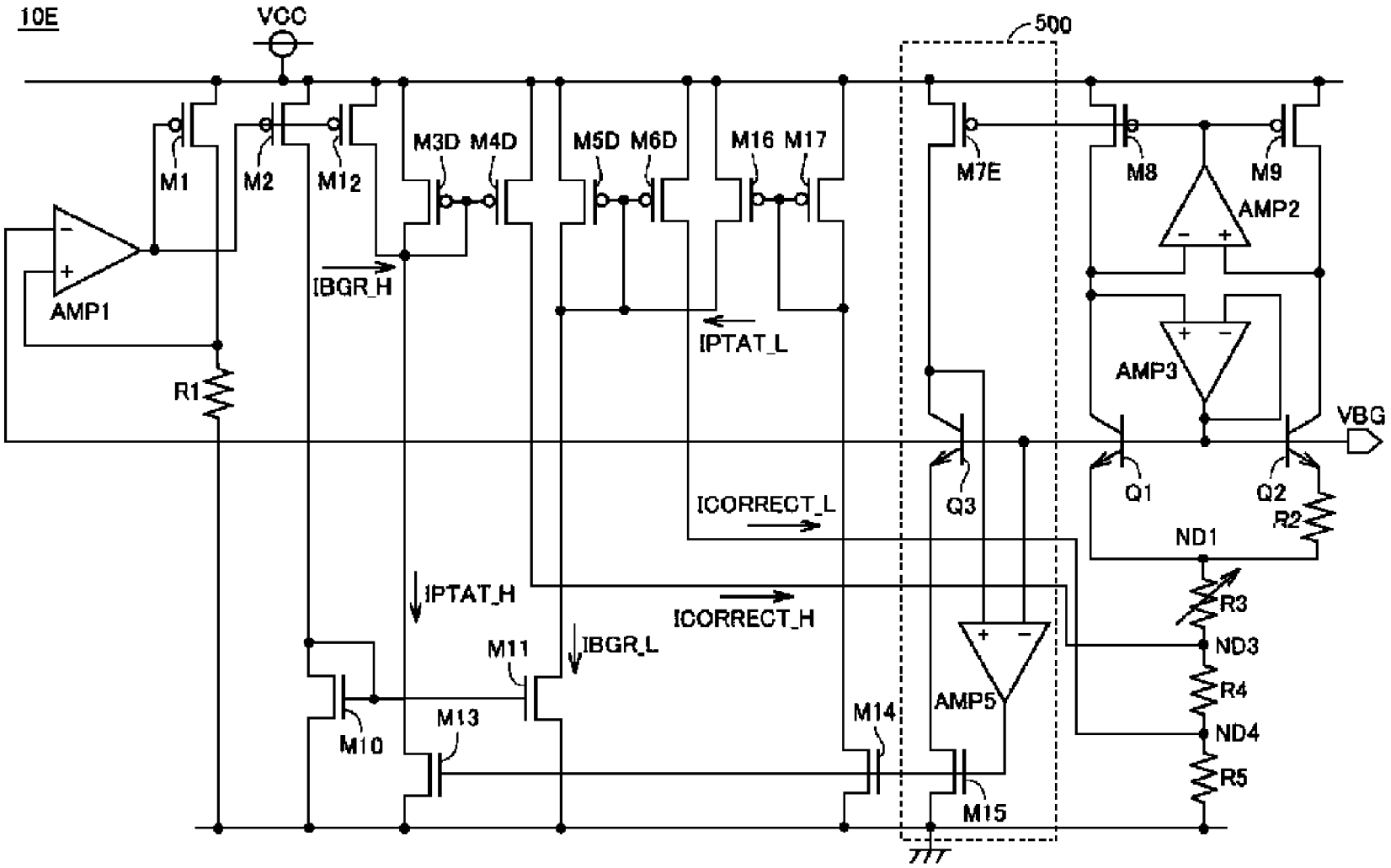
FIG. 17 is an explanatory diagram of the main circuit of a reference voltage generating circuit 10E of a sixth embodiment.

FIG. 17 is an explanatory diagram of the main circuit of a reference voltage generating circuit 10E of a sixth embodiment. The reference voltage generating circuit 10E will be described in comparison with the reference voltage generating circuit 10D of the fifth embodiment.

Referring to FIG. 17, the reference voltage generating circuit 10E further includes, in addition to the configuration of the reference voltage generating circuit 10D of the fifth embodiment, PMOS transistors M16 and M17, an NMOS transistor M15, a bipolar transistor Q3, and the AMP5. The PMOS transistor M7E, the bipolar transistor Q3, the AMP5, and the NMOS transistor M17 are also collectively referred to as the base current compensation circuit 500.

Here, the PMOS transistors M16 and M17 of the reference voltage generating circuit 10E constitute a current mirror, the gates of the PMOS transistors M16 and M17 are coupled to the drain of the NMOS transistor M14, and are also coupled to the drain of the PMOS transistor M17. In addition, the sources of the PMOS transistors M16 are M17 are coupled to the power source voltage VCC. The PMOS transistor M16 corresponds to the PMOS transistor M15D of the fifth embodiment (FIG. 15).

The gate of the NMOS transistor M14 is coupled to the gate of the NMOS transistor M13, and is also coupled to the gate of the NMOS transistor M15 of the base current compensation circuit 500 and the output terminal of the AMP5.

The source of the NMOS transistor M14 is coupled to the ground, and its drain is coupled to the gates of the PMOS transistors M16 and M17 and the drain of the PMOS transistor M17.

In the base current compensation circuit 500, the gate of the PMOS transistor M7E is coupled to the gates of the PMOS transistors M8 and M9, and is also coupled to the output terminal of the AMP2. In addition, the source of the PMOS transistor M7E is coupled to the power source voltage VCC. The drain of the PMOS transistor M7E is coupled to the collector terminal of the bipolar transistor Q3, and is also coupled to the positive input terminal of the AMP5.

The base terminal of bipolar transistor Q3 is coupled to the base terminals of the NPN-type bipolar transistors Q1 and Q2, and is also coupled to the negative input terminal of the AMP1. In addition, the base terminal of bipolar transistor Q3 has the bandgap reference voltage VBG supplied thereto. In addition, the emitter terminal of the bipolar transistor Q3 has the drain of the NMOS transistor M15 coupled thereto.

The positive input terminal of the AMP5 is coupled to the drain of the PMOS transistor M7E, and is also coupled to the collector terminal of the bipolar transistor Q3. The negative input terminal of the AMP5 is coupled to the base terminals of the NPN-type bipolar transistors Q1 to Q3, and is also coupled to the negative input terminal of the AMP1. The negative input terminal of the AMP5 has the bandgap reference voltage VBG supplied thereto. The output terminal of the AMP5 is coupled to the gates of the NMOS transistors M13, M14, and M15. The NMOS transistor M13 corresponds to the NMOS transistor M13D of the fifth embodiment (FIG. 15).

The gate of the NMOS transistor M15 is coupled to the output terminal of the AMP5, and is also coupled to the gates of the NMOS transistors M13 and M14. The drain of the NMOS transistor M15 is coupled to the emitter terminal of the bipolar transistor Q3, and the source of the NMOS transistor M15 is coupled to the ground.

The resistors R3 to R5 are coupled in series and provided between the node ND1 and the ground. The node ND4 to which the resistors R4 and R5 are coupled is coupled to the drain of the PMOS transistor M6D of the linear approximate correction current generating circuit.

In addition, the node ND3 having the resistors R3 and R4 coupled thereto is coupled to the drain of the PMOS transistor M4D of the linear approximate correction current generating circuit. According to the temperature setting that causes the compensation currents at the high-temperature side and the low-temperature side to start flowing, the drain of the PMOS transistor M6D may be coupled to the node ND3 and the drain of the PMOS transistor M4D may be coupled to the node ND4, or the drains of the PMOS transistors M4D and M6D may both be coupled to the node ND3 or the node ND4.

An explanation will be provided in which the base current compensation circuit 500 cancels the influence of the base current of the bipolar transistor Q2 by the transistor Q3. Since the current flowing in the NMOS transistor M15 flows via the bipolar transistor Q3, the current is influenced by the current amplification factor $\beta_{Q3}$ of the bipolar transistor Q3 as shown in Expression (12).

[Formula 12]

$$IPTAT_H = a*I2'*(1+\beta_{Q3})/\beta_{Q3} \quad \text{Expression (12)}$$

Here, a denotes the current mirror ratio between M7E and M9 of the current mirror including the PMOS transistors M7E, M8, and M9, $\beta_{Q3}$ denotes the current amplification factor of the bipolar transistor Q3, and the current I2' is the collector current I2' of the bipolar transistor Q2.

Expression (13) is derived by substituting Expressions (4) and (5) into the current I2' of Expression (12). As indicated by Expression (13), $(\beta_{Q2}/(1+\beta_N))$ indicating the influence of the current amplification factor of the bipolar transistor Q2 is multiplied by the reciprocal number of $\beta_{Q3}/(1+\beta_{Q3}))$ indicating the influence of the current amplification factor of the bipolar transistor Q3. Since the bipolar transistors Q2 and Q3 are fabricated over a same semiconductor chip and the current amplification factors of the bipolar transistors Q2 and Q3 can be regarded as approximately the same, influence of the current amplification factor of the bipolar transistor Q2 is canceled.

[Formula 13]

$$IPTAT_H = a*(k_B/q)*(\ln(M)/R_2)*(\beta_{Q2}/(1+\beta_{Q2}))*((1+\beta_{Q3})/\beta_{Q3})*T \quad \text{Expression (13)}$$

Here, $\beta_{Q2}$ indicates the current amplification factor of the bipolar transistor Q2. As indicated by Expression (13), adding the base current of the bipolar transistor Q3 allows highly precise temperature correction which is less susceptible to the process even if the current amplification factor is small. The sixth embodiment may be practiced in combination with other embodiments.

Finally, the embodiments will be summarized, referring again to the drawings including FIG. 1, etc. As shown in FIGS. 3, 7, 9, 12, and 15, the first to fifth embodiments include the BGR circuits 100, 100A, 100C, and 100D which generate a bandgap reference voltage, the BGR current generating circuits 200 and 200A to 200D which generate a bandgap current according to the bandgap reference voltage, the PTAT current generating circuits 400 and 400A to 400D which generate a current proportional to the absolute temperature, and linear approximate correction current generating circuits 300, 300A, 300B, 300C_1, 300C_2, 300D_1, and 300D_2 which compare the current generated by the PTAT current generating circuit and the bandgap current to generate a correction current, and the bandgap reference circuit outputs a bandgap reference voltage to which the correction voltage generated based on the correction current is added.

Preferably, as shown in FIGS. 5A to 5C, the linear approximate correction current generating circuit 300 generates the correction current when the current generated from the PTAT current generating circuit 400 is larger than the bandgap current.

Preferably, as shown in FIGS. 10A to 10C, the linear approximate correction current generating circuit 300A generates the correction current when the current generated from the PTAT current generating circuit 400A is smaller than the bandgap current.

As shown in FIGS. 3, 9, 12, and 15, the first and third to fifth embodiments include the BGR circuits 100, 100C, and 100D which generate a bandgap reference voltage, the BGR current generating circuits 200 and 200B to 200D which generate a bandgap current according to the bandgap reference voltage, the PTAT current generating circuits 400 and 400B to 400D which generate a current proportional to the absolute temperature, and the linear approximate correction current generating circuits 300, 300B, 300C_1, 300C_2, 300D_1, and 300D_2 which generate a correction current when the current generated by the PTAT current generating circuit is larger than the bandgap current, and the BGR circuit outputs a corrected bandgap reference voltage VBG with extremely low temperature dependence by adding a correction voltage generated based on the correction current.

Preferably, the BGR circuits 100, 100C, and 100D include the reference voltage output generating circuits 110, 110C, and 110D, the reference voltage output generating circuits 110, 110C, and 110D each have a plurality of resistors R2 to R5, which are coupled in series, and the output of the correction circuit is coupled to one of a plurality of coupling nodes between the resistors to generate a correction voltage.

In addition, as shown in FIG. 12, the fourth embodiment preferably has a plurality of linear approximate correction current generating circuits, among which a first linear approximate correction current generating circuit (300C_1) performs correction of a first output voltage which is an output voltage of the BGR circuit in a range from a first temperature to a second temperature and outputs a first correction current; a second linear approximate correction current generating circuit (300C_2) among the correction circuits performs correction of a second output voltage which is an output voltage of the BGR circuit in a range from the second temperature to a third temperature and outputs a second correction current; the BGR circuit 100C adds a first correction voltage generated based on the first correction current to the first output voltage, and outputs a first corrected bandgap reference voltage, in the range from the first temperature to the second temperature; the BGR circuit 100C adds, to the second bandgap reference voltage, a voltage obtained by adding the first correction voltage to the second correction voltage generated based on the second correction current, and outputs the corrected second output voltage, in the range from the second temperature to the third temperature.

In addition, as shown in FIG. 7, the second embodiment is a reference voltage generating circuit including the BGR circuit 100A which generates a bandgap reference voltage, the BGR current generating circuit 200A which generates a bandgap current according to the bandgap reference voltage, the PTAT current generating circuit 400A which generates a current proportional to the absolute temperature, the linear approximate correction current generating circuit 300A which generates a correction current based on the bandgap current and the current generated by the PTAT current generating circuit, the reference voltage output generating circuit 110A which generates a bandgap reference voltage, and the AMP4 which compares the voltage output from the BGR circuit and the voltage output from the reference voltage output generating circuit, and outputs a corrected reference voltage VREF with extremely low temperature dependence, and the positive input terminal of AMP4 has the output of the BGR circuit coupled thereto, and the negative input terminal has the output of the reference voltage output generating circuit coupled thereto.

Preferably, the reference voltage output generating circuit 110A includes a plurality of resistors R4 to R6, which are coupled in series, and the output of the linear approximate correction current generating circuit 300A is coupled to one of the coupling nodes between the resistors.

More preferably, the linear approximate correction current generating circuits 300, 300B, 300C_1, 300C_2, 300D_1, and 300D_2 each include a current mirror circuit including a plurality of PMOS transistors, as shown in FIGS. 3, 9, 12, and 15.

Further preferably, the linear approximate correction current generating circuit 300A includes a current mirror circuit including a plurality of NMOS transistors, as shown in FIG. 7.

The embodiments disclosed herein are illustrative only, and should be considered not restrictive in all respects. The scope of the present invention is defined in the appended claims rather than the above description, and is intended to include any modification or variation within the range of the claims and meanings of equivalents thereof.

What is claimed is:

1. A reference voltage generating circuit comprising:

a bandgap reference circuit which generates a bandgap reference voltage;

a bandgap current generating circuit which generates a bandgap current according to the bandgap reference voltage;

a PTAT current generating circuit which generates a current proportional to absolute temperature; and a correction circuit which compares the current generated by the PTAT current generating circuit and the bandgap current to generate a correction current, wherein the bandgap reference circuit comprises a BGR circuit and a reference voltage output generating circuit, wherein the reference voltage output generating circuit converts the correction current to a correction voltage and add the correction voltage to a voltage which the BGR circuit generates.

2. The reference voltage generating circuit according to claim 1, wherein the correction circuit generates the correction current when a current generated by the PTAT current generating circuit is larger than the bandgap current.

3. The reference voltage generating circuit according to claim 1, wherein the correction circuit generates the correction current when a current generated by the PTAT current generating circuit is smaller than the bandgap current.

4. The reference voltage generating circuit according to claim 1, wherein the reference voltage output generating circuit has a plurality of resistors, the resistors are coupled in series, and the output of the correction circuit is coupled to one of a plurality of coupling nodes between the resistors to generate the correction voltage.

* * * * *